US010582281B2

(12) United States Patent
Horikiri et al.

(10) Patent No.: US 10,582,281 B2
(45) Date of Patent: Mar. 3, 2020

(54) SPEAKER GRILLE AND SPEAKER DEVICE

(71) Applicant: SONY CORPORATION, Tokyo (JP)

(72) Inventors: Takayuki Horikiri, Kanagawa (JP); Shunsuke Shiomi, Tokyo (JP); Shogo Yashiro, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 15/773,006

(22) PCT Filed: Jul. 12, 2017

(86) PCT No.: PCT/JP2017/025430
§ 371 (c)(1),
(2) Date: May 2, 2018

(87) PCT Pub. No.: WO2018/042901
PCT Pub. Date: Mar. 8, 2018

(65) Prior Publication Data

US 2019/0182571 A1 Jun. 13, 2019

(30) Foreign Application Priority Data

Aug. 31, 2016 (JP) ..... 2016-169690

(51) Int. Cl.
*H04R 1/02* (2006.01)
*H04R 7/04* (2006.01)
*H04R 9/02* (2006.01)

(52) U.S. Cl.
CPC ..... *H04R 1/023* (2013.01); *H04R 7/04* (2013.01); *H04R 9/025* (2013.01)

(58) Field of Classification Search
CPC ..... H04R 1/023; H04R 7/04; H04R 9/025
See application file for complete search history.

(56) References Cited

U.S. PATENT DOCUMENTS 4,972,488 A * 11/1990 Weiss ..... H04R 25/654 381/322

FOREIGN PATENT DOCUMENTS

JP 09-302222 A 11/1997
JP 2002-305784 A 10/2002

OTHER PUBLICATIONS

International Search Report and Written Opinion of PCT Application No. PCT/JP2017/025430, dated Sep. 26, 2017, 09 pages.

(Continued)

*Primary Examiner* — Sunita Joshi
(74) *Attorney, Agent, or Firm* — Chip Law Group

(57) ABSTRACT

Sound quality is improved. A speaker device includes: a frame which functions as a housing; a diaphragm which vibrates when sound is outputted; a magnetic circuit which vibrates the diaphragm; and a speaker grille which is attached to the frame, in which the speaker grille is provided with a frame-shaped portion formed into an annular shape and a crosspiece portion positioned at an inner side of the frame-shaped portion and partly continuous with the frame-shaped portion, and the crosspiece portion is formed into a non-concentric shape as well as at least partly formed as a curved portion with a curved shape. Thus, since the crosspiece portion is constituted with the structure having the curved portion in a state in which the constitution with a concentric shape is not present, dips, in particular, hardly occur in the frequency characteristics, and a good output state of sound can be secured.

14 Claims, 24 Drawing Sheets

(56) References Cited

OTHER PUBLICATIONS

Dave Smith, "19 Wild Innovations in BMW's Latest Luxury Car", Business Insider, https://www.businessinsider.com.au/bmw-7-series-19-wild-innovations-features-2015-8, Aug. 3, 2015, 02 pages.

* cited by examiner

SPEAKER GRILLE AND SPEAKER DEVICE

CROSS REFERENCE TO RELATED APPLICATIONS

This application is a U.S. National Phase of International Patent Application No. PCT/JP2017/025430 filed on Jul. 12, 2017, which claims priority benefit of Japanese Patent Application No. JP 2016-169690 filed in the Japan Patent Office on Aug. 31, 2016. Each of the above-referenced applications is hereby incorporated herein by reference in its entirety.

TECHNICAL FIELD

The present technology relates to a technical field of a speaker grille which has a frame-shaped portion annularly formed and a crosspiece portion positioned at the inner side of the frame-shaped portion, and a speaker device including the same.

BACKGROUND ART

There is a speaker device which outputs sound amplified by an amplifier. The speaker device generally includes a frame which functions as a housing, a diaphragm which vibrates when sound is outputted, a magnetic circuit which vibrates the diaphragm, and a speaker grille attached to the frame. The sound outputted according to the vibration of the diaphragm is outputted to the outside through the speaker grille.

By providing the speaker device with the speaker grille, contact of a finger to the internal structure of the speaker device, and the like are prevented and the internal structure is protected.

The speaker grille used for the speaker device may be provided in various shapes. For example, there is a speaker grille formed with structure having a concentric shape (e.g., see Patent Document 1).

The speaker grille described in Patent Document 1 has concentric structure formed by a plurality of toric portions with different diameters, in which the plurality of toric portions is coupled and constituted by linear portions extending in the radial direction, and the pitches of the adjacent toric portions are made different.

CITATION LIST

Patent Document

Patent Document 1: JP 2002-305784 A

SUMMARY OF THE INVENTION

Problems to be Solved by the Invention

Incidentally, in the speaker device having the speaker grille as described above, sound is outputted through an opening formed in the speaker grille, so that sound interference and blocking occurs sometimes due to the speaker grille. When such sound interference or blocking occurs due to the speaker grille, peaks and dips may possibly occur in the frequency characteristics. In a case where the speaker grille has concentric structure, in particular, dips may possibly occur, which causes deterioration of the sound quality.

Thereupon, an object of a speaker grille and a speaker device according to the present technology is to overcome the problems described above and improve sound quality.

Solutions to Problems

Firstly, a speaker grille according to the present technology includes: a frame-shaped portion which is formed into an annular shape; and a crosspiece portion which is positioned at the inner side of the frame-shaped portion and partly continuous with the frame-shaped portion, in which the crosspiece portion is formed into a non-concentric shape as well as at least partly formed as a curved portion with a curved shape.

With this arrangement, the speaker grille has a structure, in which the crosspiece portion has the curved portion in a state where the constitution with a concentric shape is not present.

Secondly, in the speaker grille described above, it is desirable that the frame-shaped portion be formed into a toric shape.

With this arrangement, the frame-shaped portion has a simple shape.

Thirdly, in the speaker grille described above, it is desirable that the crosspiece portion be formed into a point-symmetric shape about the center of the frame-shaped portion.

With this arrangement, openings which are spaces at the inner side of the crosspiece portion are formed into point-symmetric shapes about the center of the frame-shaped portion.

Fourthly, in the speaker grille described above, it is desirable that the crosspiece portion be provided with a plurality of the identically-shaped portions formed into the same shape and the plurality of the identically-shaped portions be continuously formed in the circumferential direction of the frame-shaped portion.

With this arrangement, the total areas of the openings of the identically-shaped portions adjacent in the circumferential direction are set to be the same.

Fifthly, in the speaker grille described above, it is desirable that the crosspiece portions be constituted by only a plurality of the curved portions.

With this arrangement, an angular portion is not in the crosspiece portion, and stress concentration hardly occurs.

Sixthly, in the speaker grille described above, it is desirable that a plurality of curvature changing portions, whose curvatures decrease from the central portion of the frame-shaped portion toward the frame-shaped portion, be provided and spaced apart from one another at the crosspiece portion in the circumferential direction of the frame-shaped portion.

With this arrangement, it is possible to constitute the crosspiece portion with spiral structure by the plurality of curvature changing portions.

Seventhly, in the speaker grille described above, it is desirable that the crosspiece portion be constituted by only the plurality of curvature changing portions.

With this arrangement, it is possible to constitute the crosspiece portion with only spiral structure by the plurality of curvature changing portions.

Eighthly, in the speaker grille described above, it is desirable that the thickness of the crosspiece portion be made thinner than the thickness of the frame-shaped portion.

With this arrangement, the openings which are the spaces at the inner side of the crosspiece portion are enlarged.

Ninthly, in the speaker grille described above, it is desirable that the thickness of the crosspiece portion be made constant.

With this arrangement, the strength of the crosspiece portion does not differ depending on sites as well as the total opening area of the openings which are the spaces at the inner side of the crosspiece portion, can be a certain level or more.

Tenthly, in the speaker grille described above, it is desirable that an annular portion be provided as a part of the crosspiece portion at the central portion of the frame-shaped portion.

With this arrangement, an opening with a certain size is formed at the central portion of the frame-shaped portion.

Eleventhly, in the speaker grille described above, it is desirable that the annular portion be formed into a toric shape.

With this arrangement, an opening with a certain size is formed as well as a portion with a toric shape is present at the central portion of the frame-shaped portion.

Twelfthly, in the speaker grille described above, it is desirable that the speaker grille include resin material containing glass filler.

With this arrangement, the strength of the material is enhanced by the glass filler.

Thirteenthly, in the speaker grille described above, it is desirable that a suppressing protrusion portion which protrudes in one side in an axial direction of the frame-shaped portion from the crosspiece portion and suppresses the vibration of a diaphragm, be provided.

With this arrangement, excessive vibration of the diaphragm is prevented by the suppressing protrusion portion when the diaphragm vibrates.

Fourteenthly, in the speaker grille described above, it is desirable that the curved portion be formed into a curved shape to which the Fibonacci sequence is applied and the plurality of the curved portions be provided and spaced apart from one another in the circumferential direction of the frame-shaped portion.

With this arrangement, it is possible to constitute the crosspiece portion with spiral structure by first curved portions and second curved portions as well as easy to design the shapes of the first curved portions and the second curved portions.

Fifteenthly, a speaker device according to the present technology includes: a frame which functions as a housing; a diaphragm which vibrates when sound is outputted; a magnetic circuit which vibrates the diaphragm; and a speaker grille which is attached to the frame, in which the speaker grille is provided with a frame-shaped portion which is formed into an annular shape, and a crosspiece portion which is positioned at an inner side of the frame-shaped portion and partly continuous with the frame-shaped portion, and the crosspiece portion is formed into a non-concentric shape as well as at least partly formed as a curved portion with a curved shape.

With this arrangement, the crosspiece portion of the speaker grille is constituted with the structure having the curved portion in a state in which the constitution with a concentric shape is not present.

Effects of the Invention

According to the present technology, since the crosspiece portion is constituted with the structure having the curved portion in a state in which the constitution with a concentric shape is not present, dips, in particular, hardly occur in the frequency characteristics, and a good output state of sound can be secured.

Note that the effects described in this description are merely examples and are not limited, and there may be other effects.

MODE FOR CARRYING OUT THE INVENTION

Hereinafter, modes for carrying out a speaker grille and a speaker device of the present technology will be described with reference to the accompanying drawings.

Note that the speaker device is provided with a frame which functions as a housing, and the speaker grille attached to the frame, the side on which the speaker grille is positioned is defined as the front side, the side on which the frame is positioned is defined as the rear side to describe vertical, front-rear and horizontal directions hereinafter. However, the vertical, front-rear and horizontal directions shown hereinafter are shown for convenience of explanation, and the present technology is not limited to these directions to be applied.

<Constitution of Speaker Device and the Like>

Figure 1:
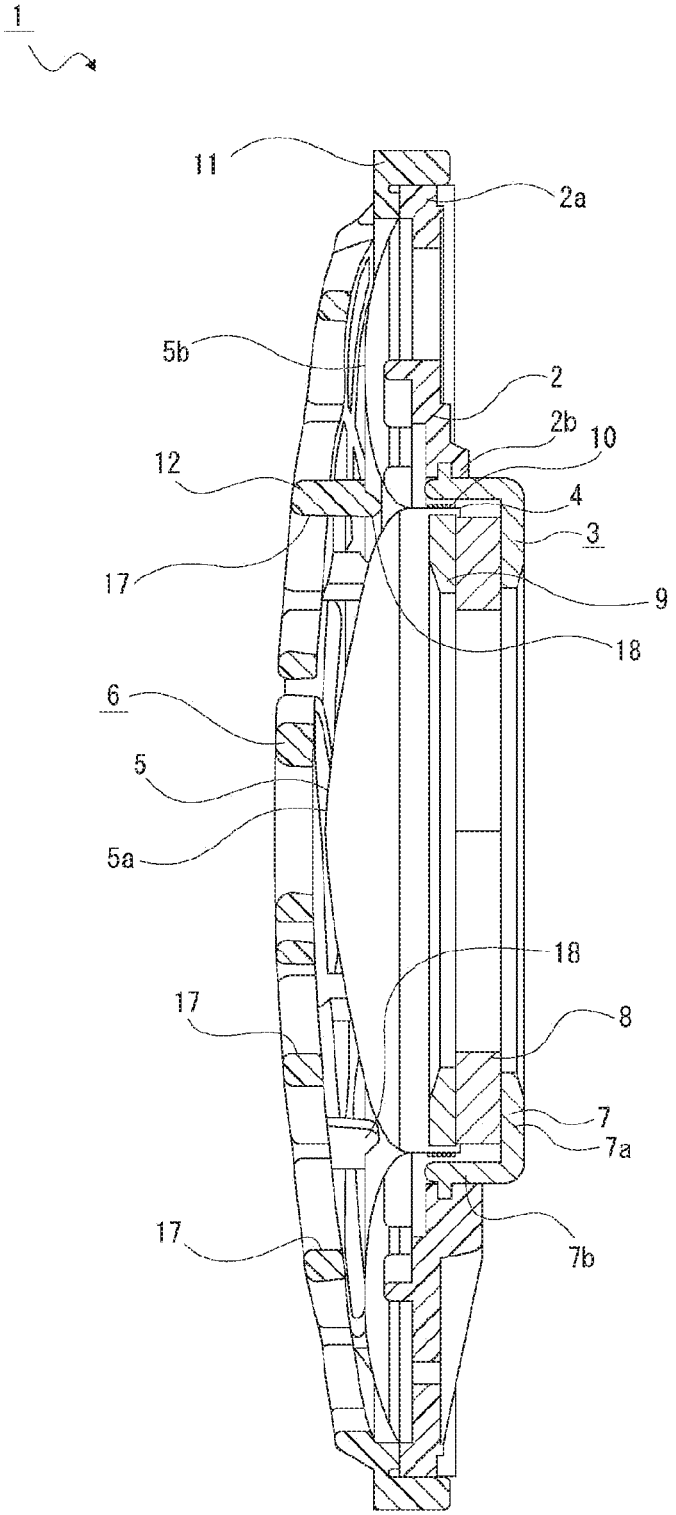
FIG. 1 shows embodiments of a speaker grille and a speaker device of the present technology together with FIGS. 2 to 45 and is a cross-sectional view of the speaker device.
Figure 2:
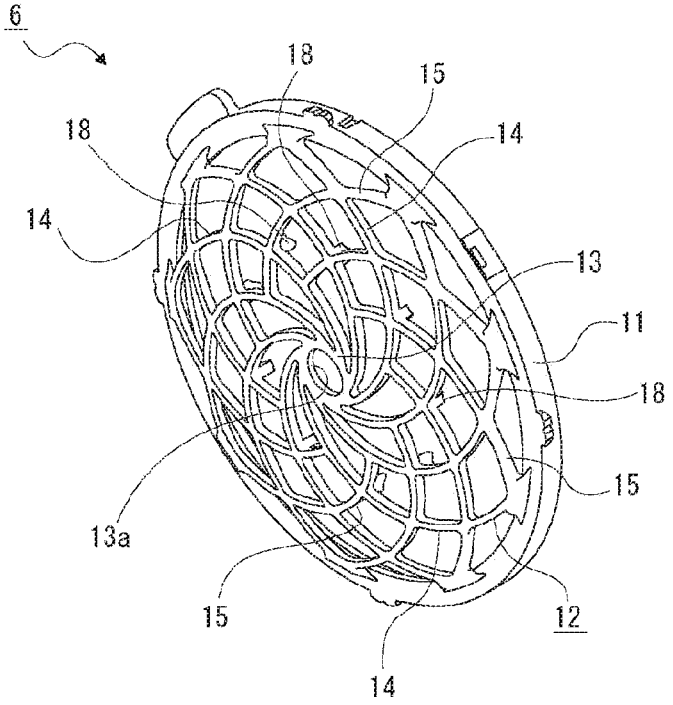
FIG. 2 is a perspective view of the speaker grille.
Figure 3:
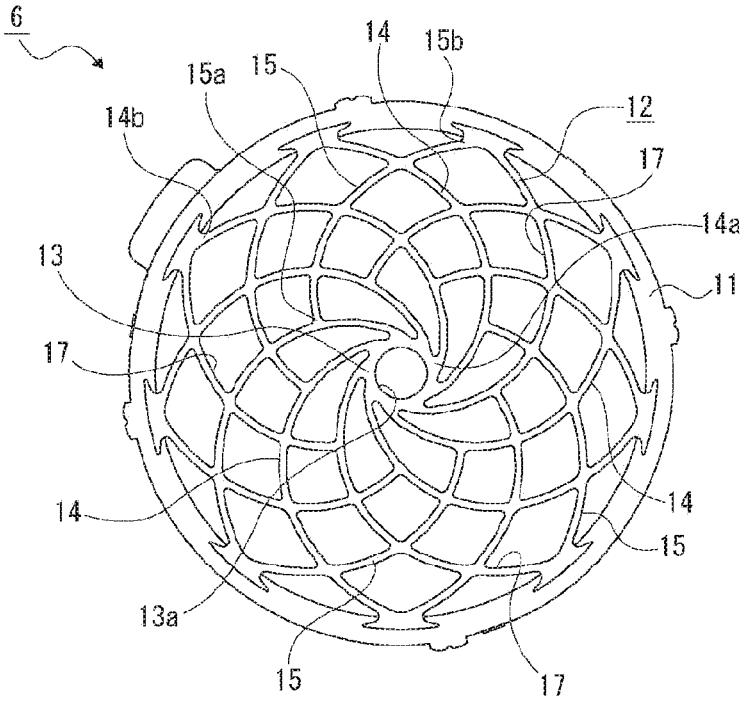
FIG. 3 is a front view of the speaker grille.
Figure 4:
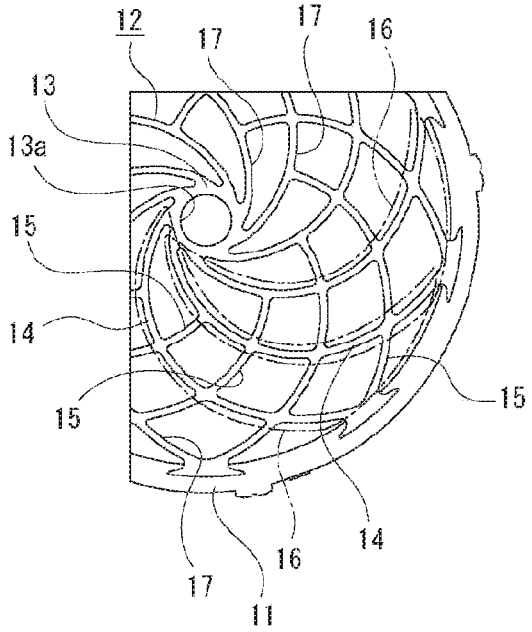
FIG. 4 is a front view showing identically-shaped portions of the speaker grille.
Figure 5:
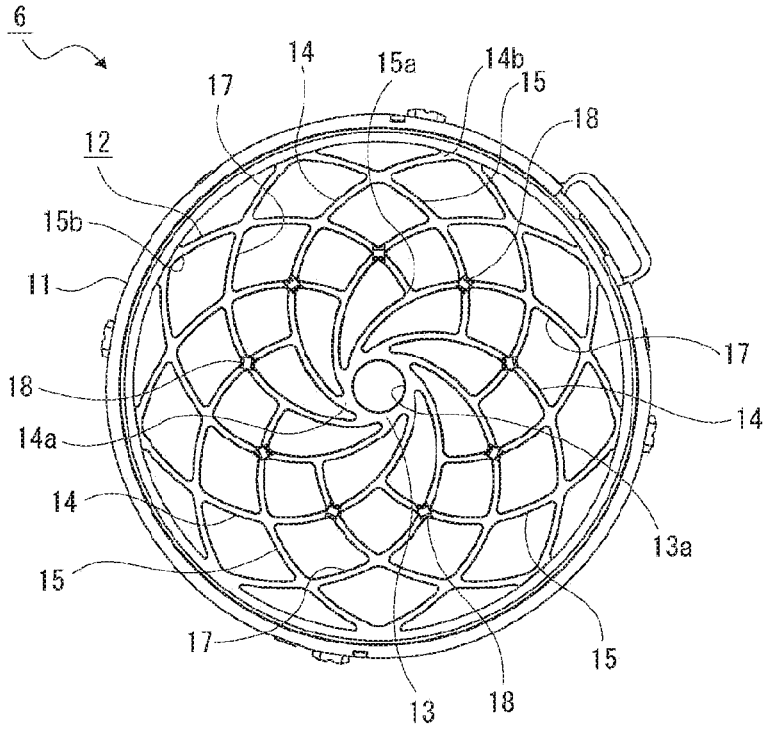
FIG. 5 is a rear view of the speaker grille.
Figure 6:
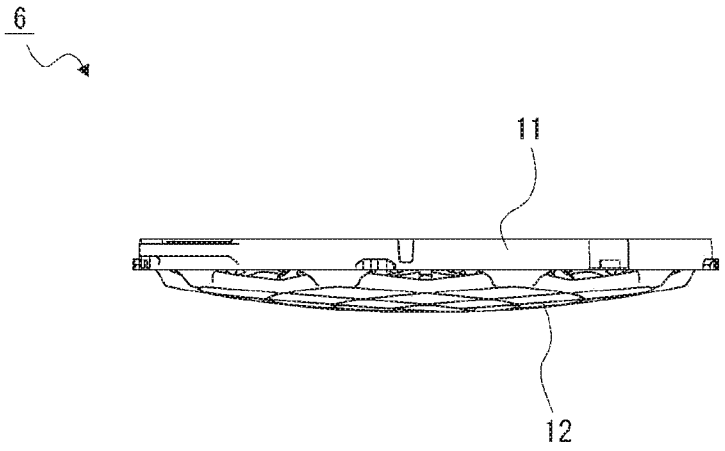
FIG. 6 is a plan view of the speaker grille.
Figure 7:
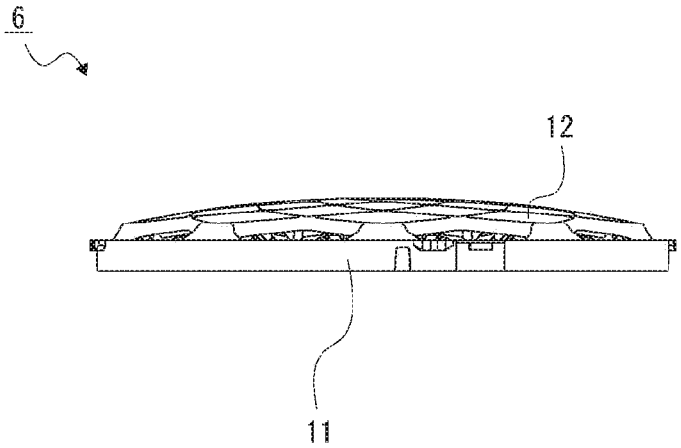
FIG. 7 is a bottom view of the speaker grille.
Figure 8:
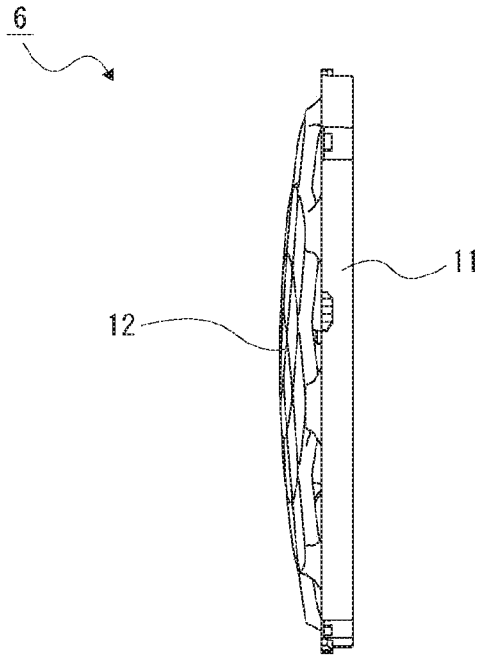
FIG. 8 is a right side view of the speaker grille.
Figure 9:
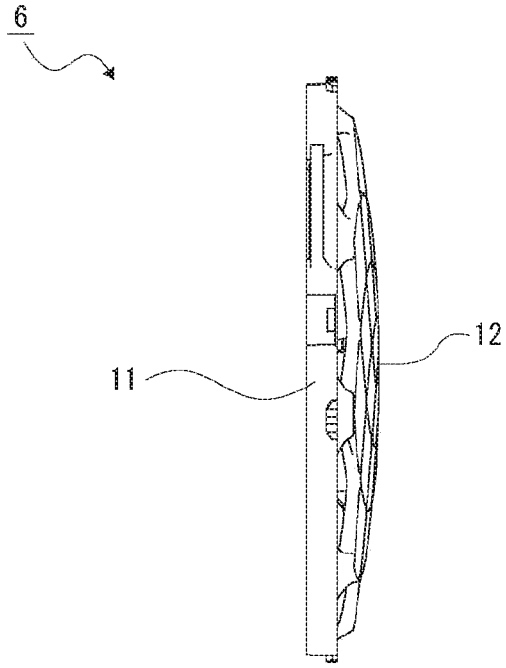
FIG. 9 is a left side view of the speaker grille.

First, the constitution of the speaker device will be described (see FIG. 1).

A speaker device 1 has a frame 2, a magnetic circuit 3, a bobbin 4, a diaphragm 5 and a speaker grille 6.

The frame 2 functions as a housing, is made including, for example, highly rigid material such as metal material or resin material containing glass filler, and is formed into a substantially toric shape as a whole. The frame 2 has the outer peripheral portion provided as a grille attachment portion 2*a*, and the inner peripheral portion provided as a yoke attachment portion 2*b*.

The magnetic circuit 3 has a yoke 7, a magnet 8, a plate 9 and a coil 10.

The yoke 7 has a toric base portion 7*a* and a cylindrical peripheral surface portion 7*b* protruding forward from the outer peripheral portion of the base portion 7*a*. The front end portion of the yoke 7 is attached to the yoke attachment portion 2*b* of the frame 2.

The magnet 8 is formed into a toric shape and attached to the front surface of the base portion 7*a* of the yoke 7.

The plate 9 is made including magnetic material such as metal, formed into a toric shape and attached to the front surface of the magnet 8. The plate 9 is positioned at the inner peripheral side of the peripheral surface portion 7*b* of the yoke 7.

The coil 10 is wound around the outer peripheral surface of the bobbin 4. The bobbin 4 is formed into a cylindrical shape and partly inserted between the peripheral surface portion 7*b* of the yoke 7 and the plate 9. The coil 10 is positioned between the peripheral surface portion 7*b* and the plate 9.

The diaphragm 5 has a dome portion 5*a* formed into a curved shape convex forward and an edge portion 5*b* continuous with the outer periphery of the dome portion 5*a*. The front end portion of the bobbin 4 is joined to a continuous portion between the dome portion 5*a* and the edge portion 5*b* of the diaphragm 5. The outer peripheral portion of the edge portion 5*b* of the diaphragm 5 is attached to the outer peripheral portion of the frame 2.

The speaker grille 6 has the outer shape formed into a substantially circular shape, and the outer peripheral portion is attached to the grille attachment portion 2*a* of the frame 2. Therefore, the outer peripheral portion of the edge portion 5*b* of the diaphragm 5 is attached to the grille attachment portion 2*a* in a state of being sandwiched between the frame 2 and the speaker grille 6.

The speaker grille 6 is made including, for example, resin material containing glass filler. The speaker grille 6 has a frame-shaped portion 11 and a crosspiece portion 12 (see FIGS. 2 to 9).

The frame-shaped portion 11 is formed into an annular shape, for example, a toric shape. Note that the frame-shaped portion 11 should only be formed into an annular shape for the outer shape of the frame 2 and may be formed into a shape, such as an ellipse, an oval, a rectangle or the like, besides the toric shape.

The crosspiece portion 12 is formed into a non-concentric shape and has an annular portion 13 provided at the central portion of the frame-shaped portion 11, first curved portions 14, 14 and so on which couple the annular portion 13 with the frame-shaped portion 11, and second curved portions 15, 15 and so on which couple the first curved portions 14, 14 and so on with the frame-shaped portion 11. The crosspiece portion 12 is gradually displaced forward from the frame-shaped portion 11 to the central portion of the frame-shaped portion 11 and formed into a convex shape toward the front as a whole. The speaker grille 6 has, for example, nine first curved portions 14, 14 and so on and nine second curved portions 15, 15 and so on.

The annular portion 13 is formed into, for example, a toric shape. A space at the inner side of the annular portion 13 is formed as an opening 13*a*.

The first curved portions 14, 14 and so on are provided and spaced apart from one another in the circumferential direction, for example, at regular intervals. One end portions 14*a* of the first curved portions 14 are made continuous with the annular portion 13, and the other end portions 14*b* the first curved portions 14 are made continuous with the frame-shaped portion 11. The first curved portions 14 are formed into, for example, curved shapes to which the Fibonacci sequence is applied. Therefore, the first curved portions 14 are provided as curvature changing portions with curved shapes whose curvatures decrease from the annular portion 13 toward the frame-shaped portion 11. The first curved portions 14, 14 and so on are each formed into curved shapes convex toward the counterclockwise direction in the front shapes and formed into a spiral shape as a whole.

The second curved portions 15, 15 and so on are provided and spaced apart from one another provided in the circumferential direction, for example, at regular intervals. One end portions 15*a* of the second curved portions 15 are made continuous with the first curved portions 14, and the other end portions 15*b* of the second curved portions 15 are made continuous with the frame-shaped portion 11. The second curved portions 15 are also formed into, for example, curved shapes to which the Fibonacci sequence is applied. Therefore, the second curved portions 15 are provided as curvature changing portions with curved shapes whose curvatures decrease from the first curved portions 14 toward the frame-shaped portion 11. The second curved portions 15, 15 and so on are each formed into curved shapes convex toward the clockwise direction in the front shapes and formed into a spiral shape as a whole.

However, when the Fibonacci sequence is applied to the central portion of the frame-shaped portion 11, the first curved portions 14, 14 and so on and the second curved portions 15, 15 and so on are closely spaced, so that an opening is not formed. Thus, there is a possibility that sound is not outputted from the central portion of the frame-shaped portion 11 and good frequency characteristics regarding the sound output are not secured.

Thereupon, in the speaker grille 6, as described above, the annular portion 13 in which the inner space is set as the opening 13*a* is formed at the central portion of the frame-shaped portion 11, and good frequency characteristics regarding the sound output are secured.

The crosspiece portion 12 is formed into the shape as described above. The first curved portions 14 and 14 adjacent to each other and respective portions of four second curved portions 15, 15 and so on positioned between these first curved portions 14 and 14 constitute the identically-shaped portion 16, and the identically-shaped portions 16, 16 and so on are continuously formed in the circumferential direction.

At the inner side of the frame-shaped portion 11, each space surrounded by each portion of the crosspiece portion 12 or by each portion of the crosspiece portion 12 and each portion of the frame-shaped portion 11 is formed as an opening 17, 17 and so on from which sound is outputted.

In the crosspiece portion 12, the thicknesses of the annular portion 13, the first curved portions 14, 14 and so on, and the second curved portions 15, 15 and so on are made, for example, constant and made thinner than the thickness of the frame-shaped portion 11.

In the speaker grille 6, suppressing protrusion portions 18, 18 and so on protruding rearward from the respective portions of the crosspiece portion 12 are provided and spaced apart from one another in the circumferential direction. The suppressing protrusion portions 18 are provided so as to protrude rearward from portions where the first curved portions 14 and the second curved portions 15 are made continuous. The suppressing protrusion portions 18, 18 and so on are positioned just the front side of the continuous portion of the dome portion 5*a* and the edge portion 5*b* of the diaphragm 5 in a state in which the speaker grille 6 is attached to the frame 2.

<Measurement Results Regarding Sound>

Hereinafter, the measurement results regarding the sound outputted from the speaker device 1 and the like will be described (see FIG. 10).

Figure 10:
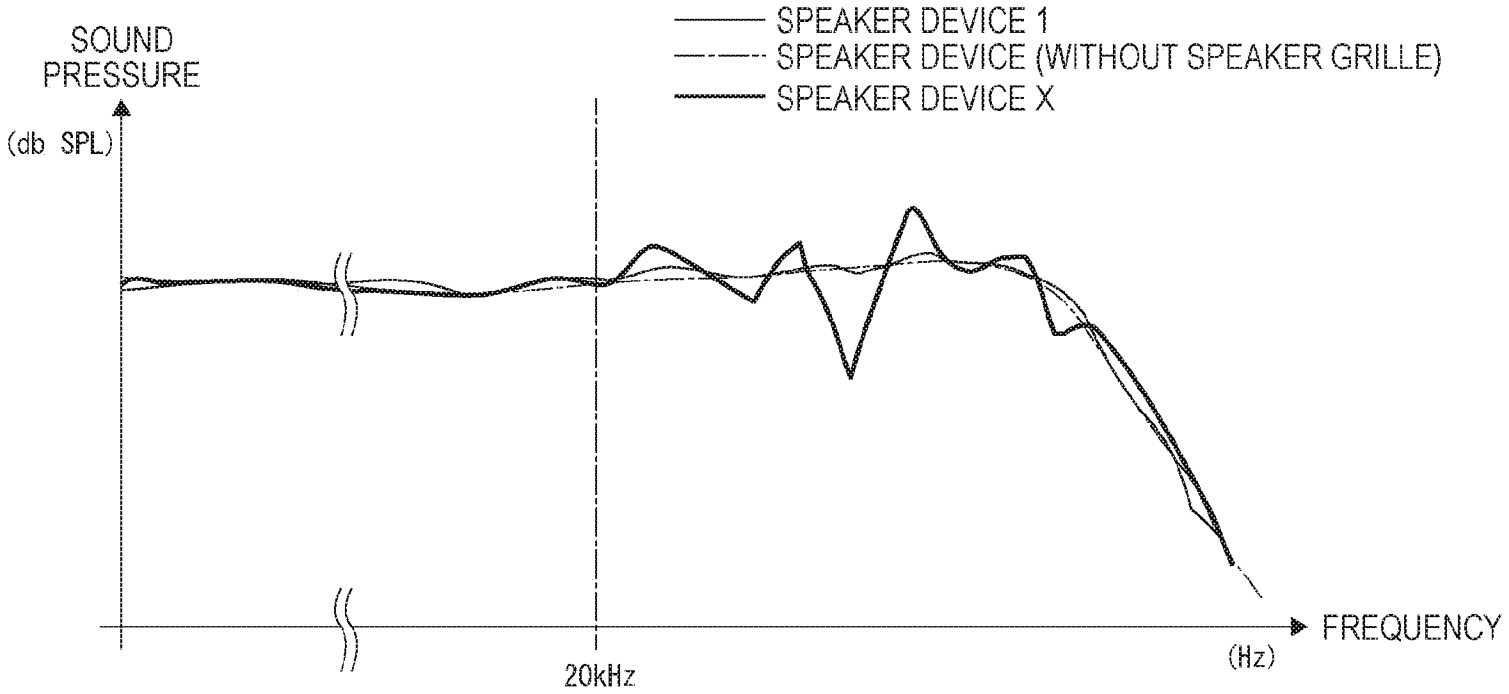
FIG. 10 is a graph showing the measurement results regarding sound pressure.
Figure 11:
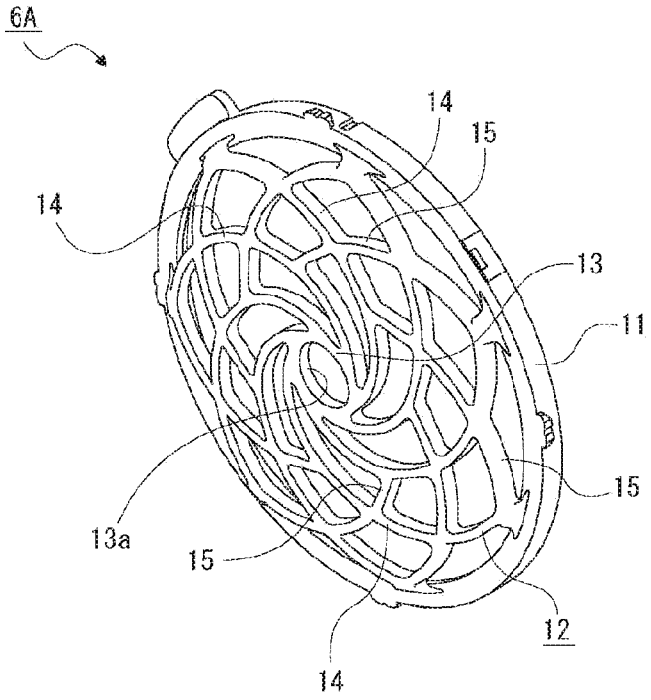
FIG. 11 is a perspective view of a speaker grille according to a first modification example.
Figure 12:
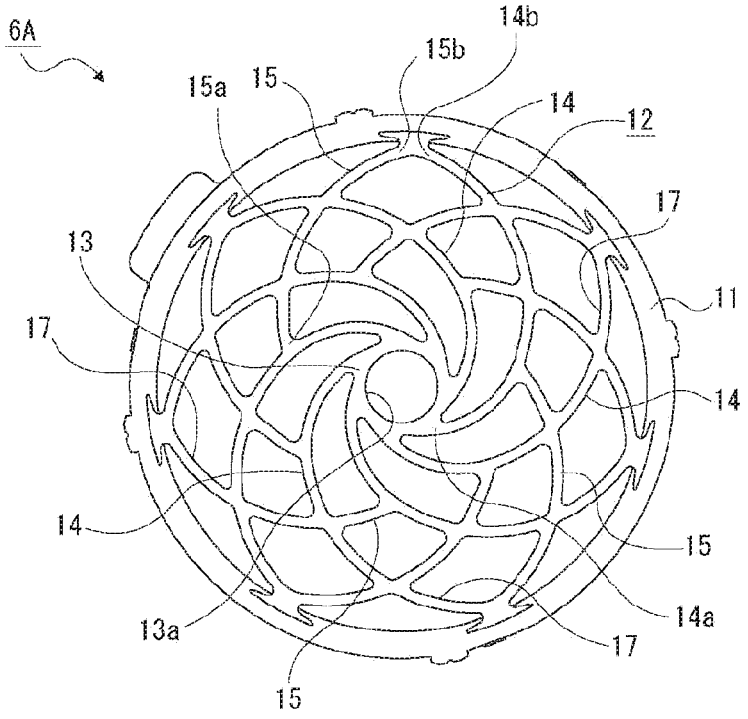
FIG. 12 is a front view of the speaker grille according to the first modification example.
Figure 13:
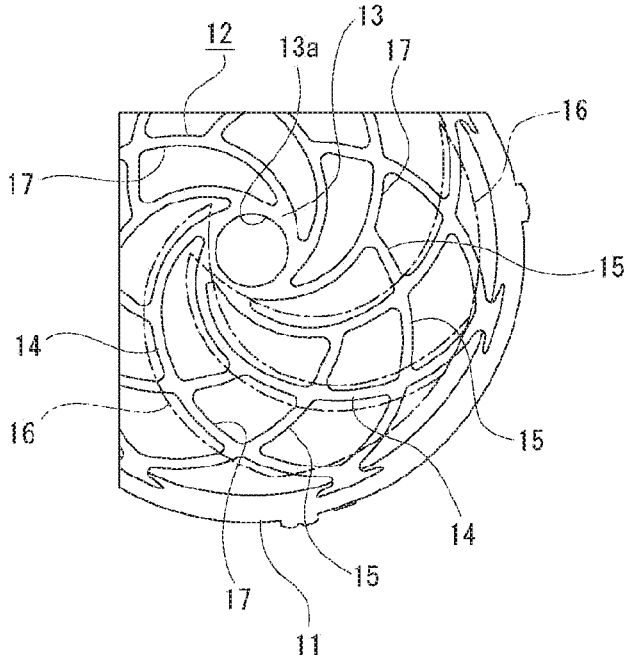
FIG. 13 is a front view showing identically-shaped portions of the speaker grille according to the first modification example.
Figure 14:
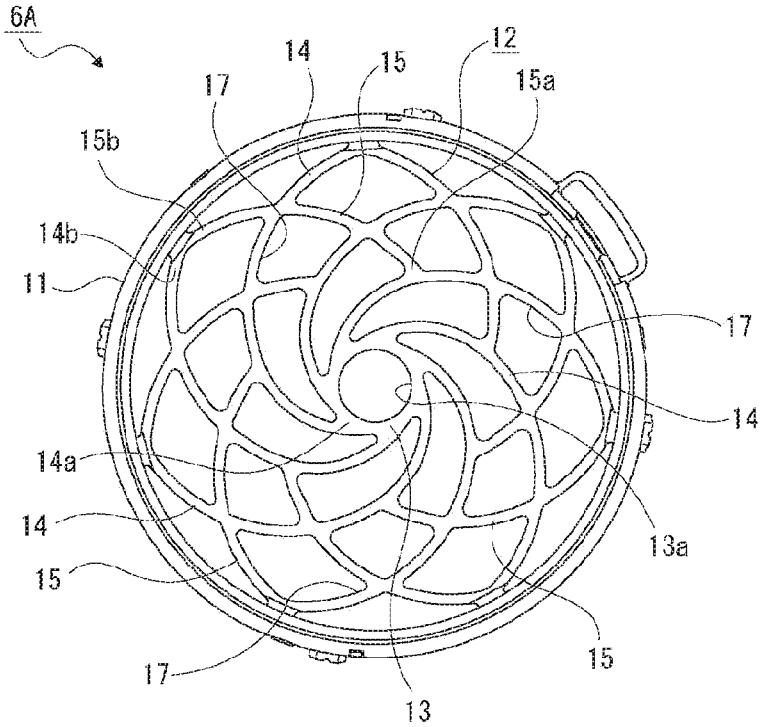
FIG. 14 is a rear view of the speaker grille according to the first modification example.
Figure 15:
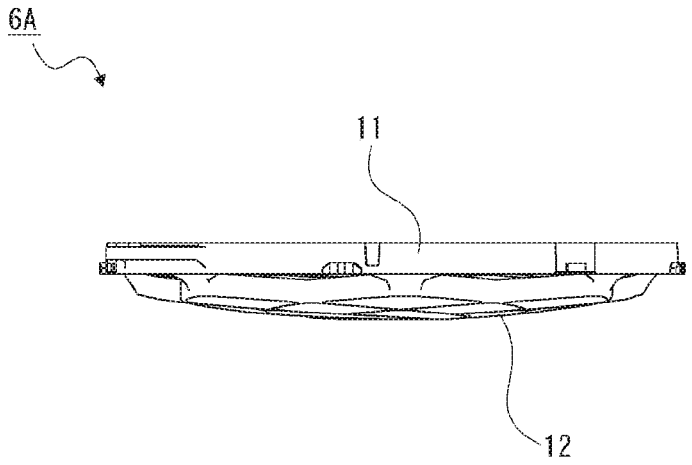
FIG. 15 is a plan view of the speaker grille according to the first modification example.
Figure 16:
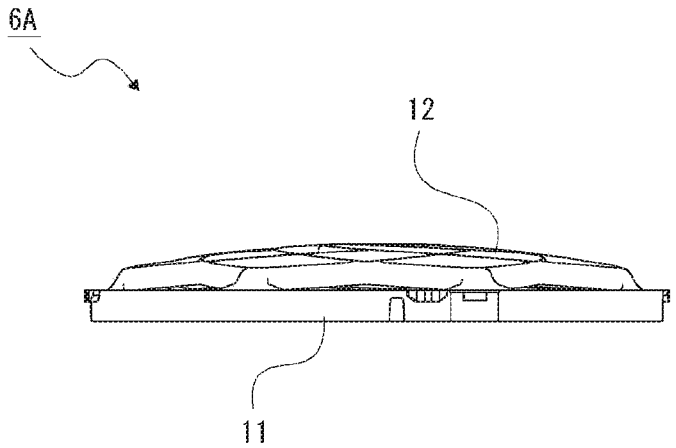
FIG. 16 is a bottom view of the speaker grille according to the first modification example.
Figure 17:
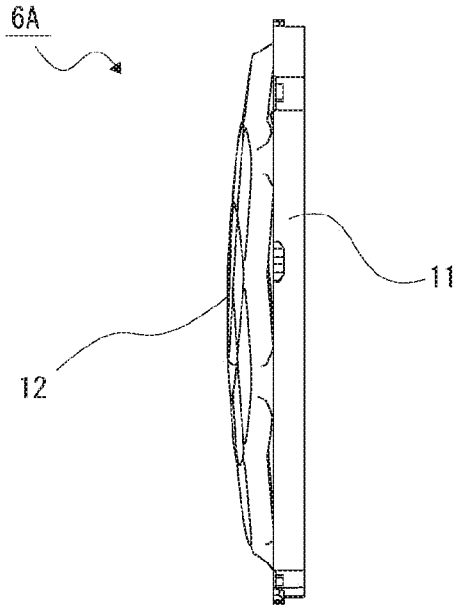
FIG. 17 is a right side view of the speaker grille according to the first modification example.
Figure 18:
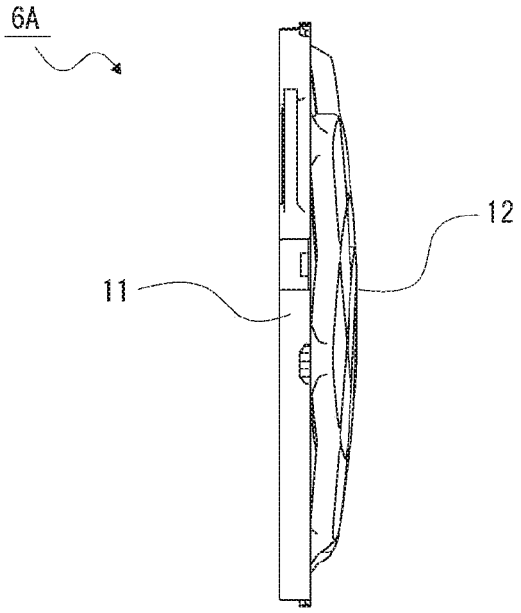
FIG. 18 is a left side view of the speaker grille according to the first modification example.
Figure 19:
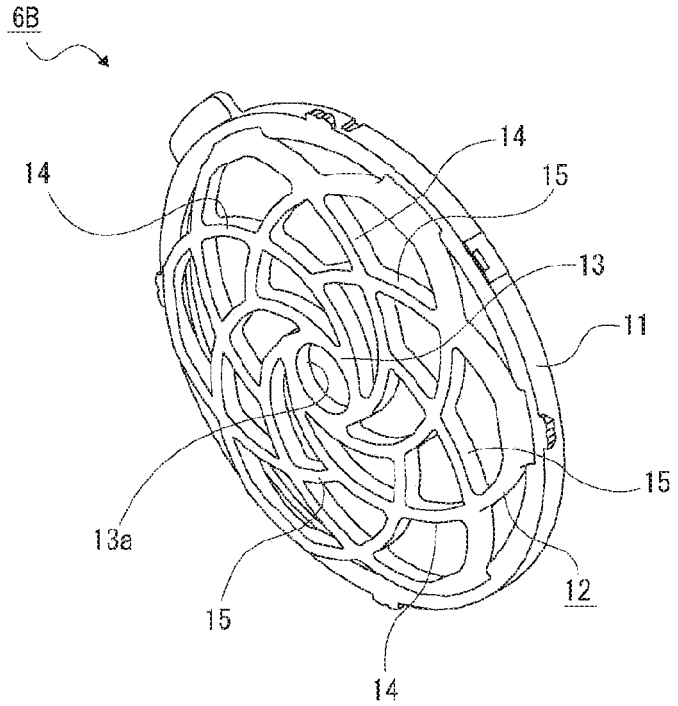
FIG. 19 is a perspective view of a speaker grille according to a second modification example.
Figure 20:
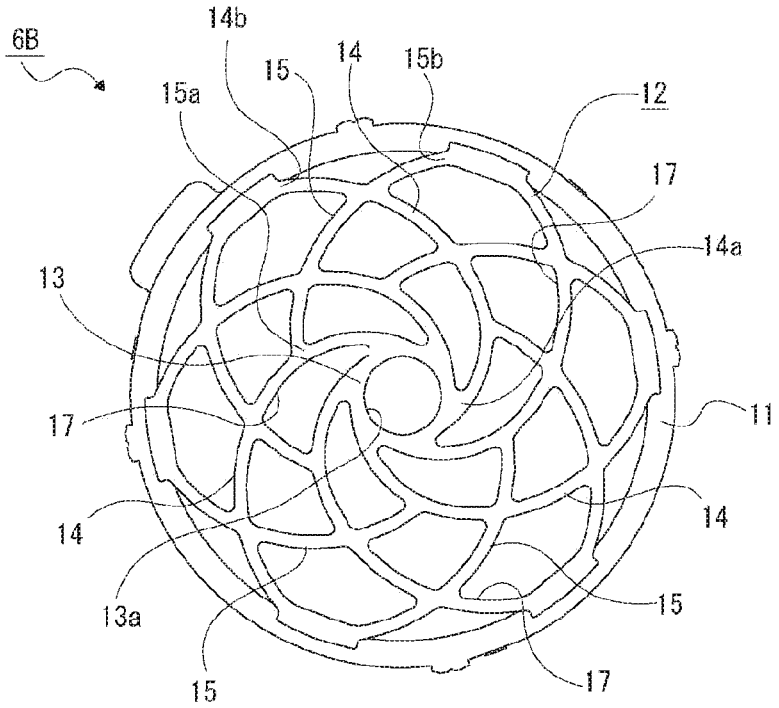
FIG. 20 is a front view of the speaker grille according to the second modification example.
Figure 21:
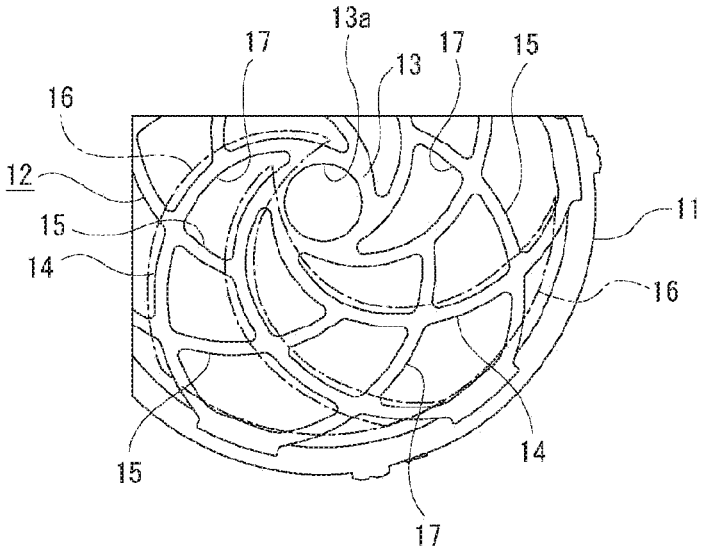
FIG. 21 is a front view showing identically-shaped portions of the speaker grille according to the second modification example.
Figure 22:
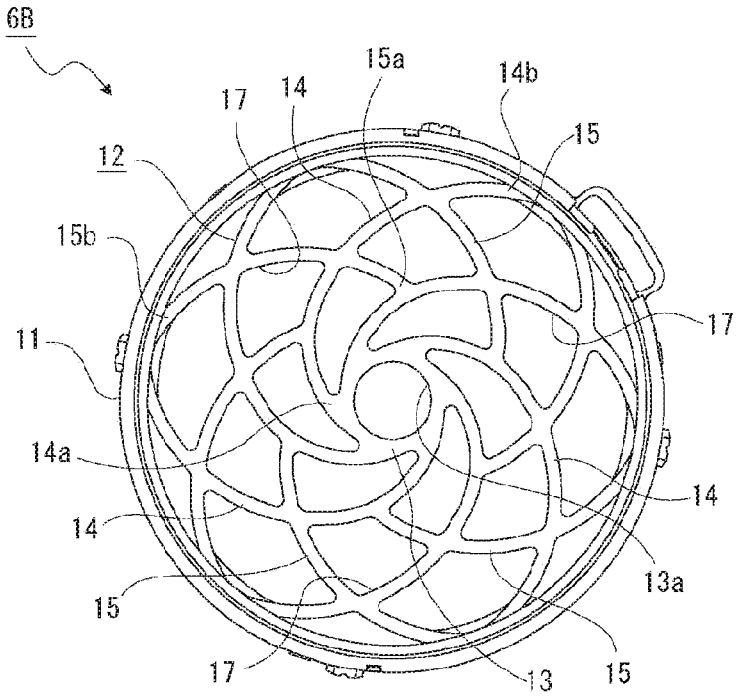
FIG. 22 is a rear view of the speaker grille according to the second modification example.
Figure 23:
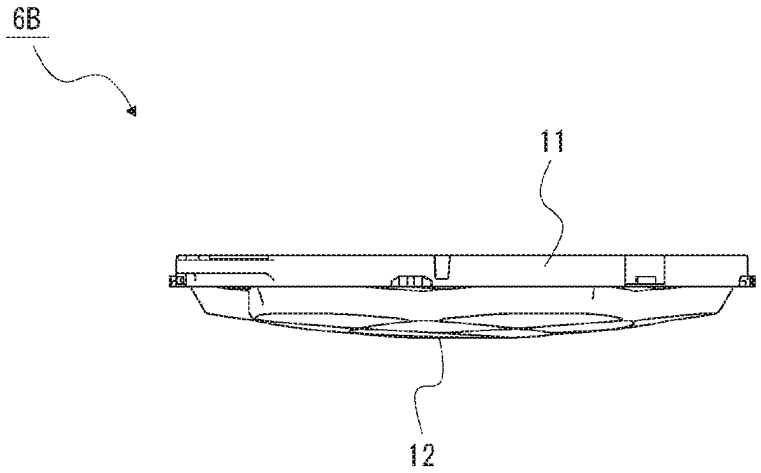
FIG. 23 is a plan view of the speaker grille according to the second modification example.
Figure 24:
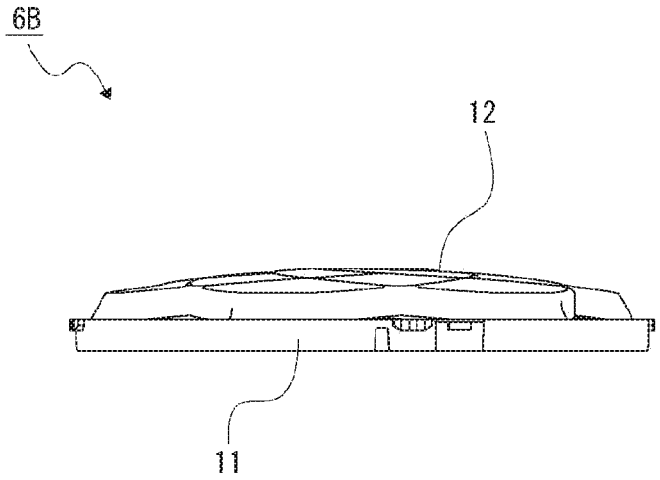
FIG. 24 is a bottom view of the speaker grille according to the second modification example.
Figure 25:
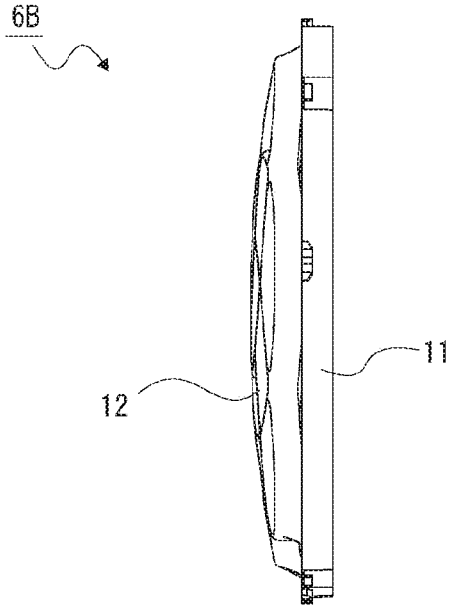
FIG. 25 is a right side view of the speaker grille according to the second modification example.
Figure 26:
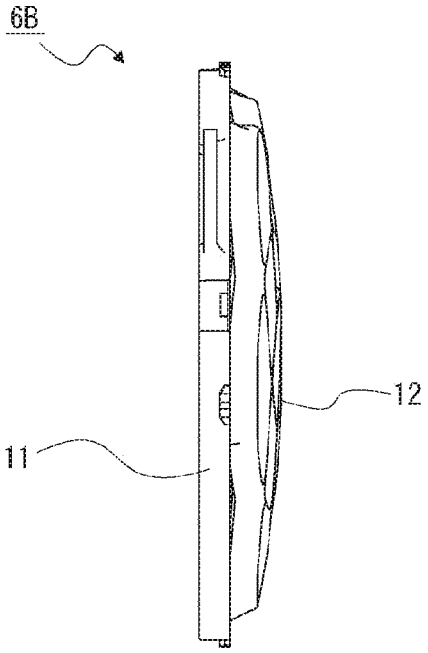
FIG. 26 is a left side view of the speaker grille according to the second modification example.
Figure 27:
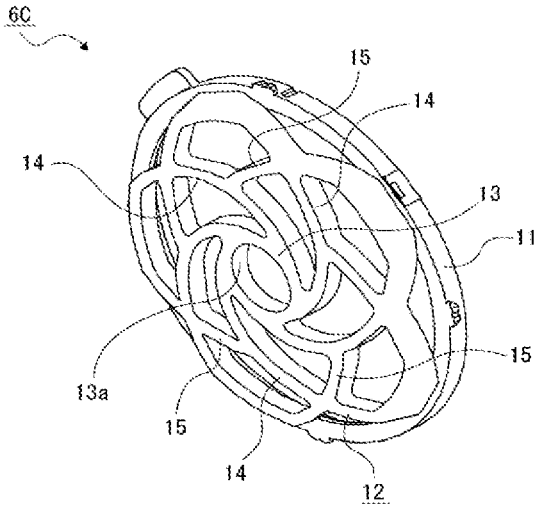
FIG. 27 is a perspective view of a speaker grille according to a third modification example.
Figure 28:
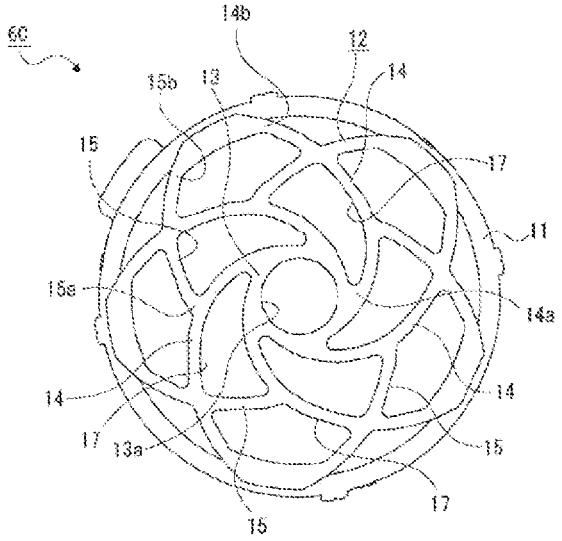
FIG. 28 is a front view of the speaker grille according to the third modification example.
Figure 29:
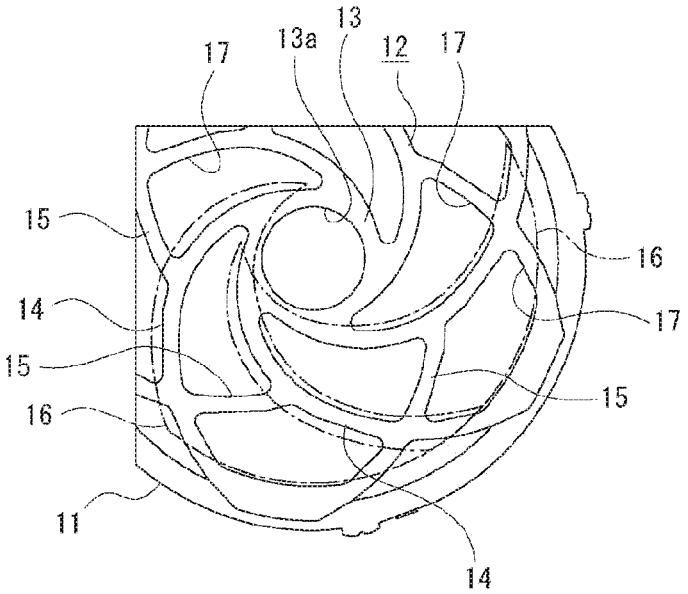
FIG. 29 is a front view showing identically-shaped portions of the speaker grille according to the third modification example.
Figure 30:
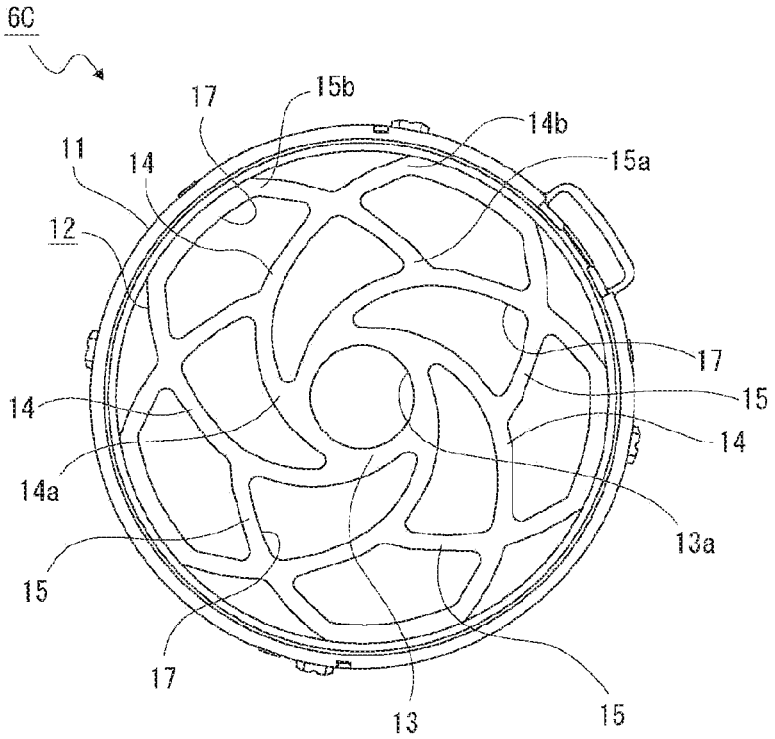
FIG. 30 is a rear view of the speaker grille according to the third modification example.
Figure 31:
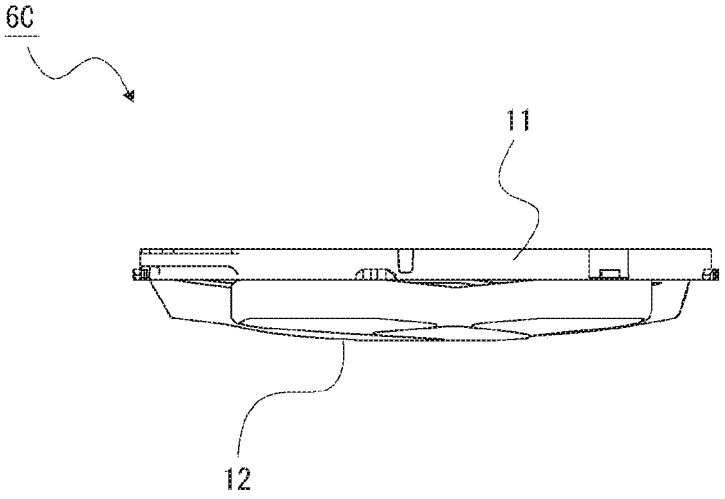
FIG. 31 is a plan view of the speaker grille according to the third modification example.
Figure 32:
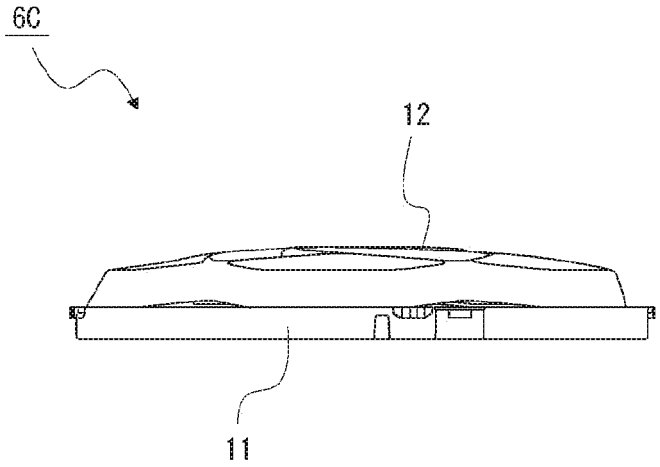
FIG. 32 is a bottom view of the speaker grille according to the third modification example.
Figure 33:
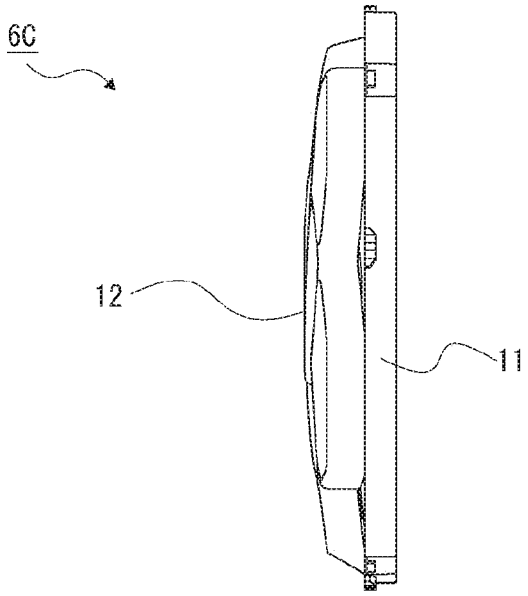
FIG. 33 is a right side view of the speaker grille according to the third modification example.
Figure 34:
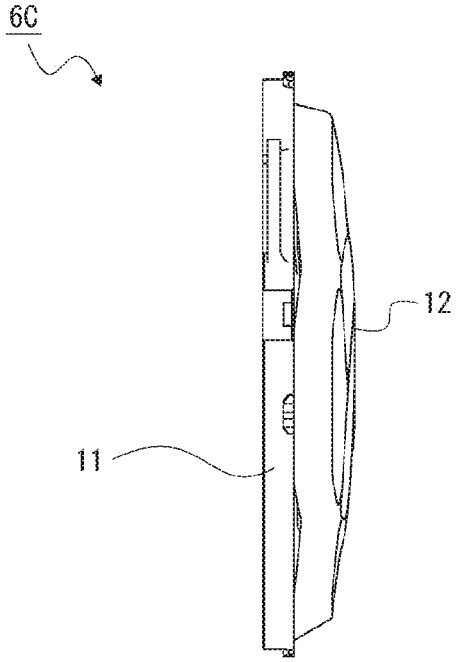
FIG. 34 is a left side view of the speaker grille according to the third modification example.

The graph shown in FIG. 10 is a graph showing the measurement results of the frequency characteristics for the speaker device 1, a conventional speaker device X provided with a speaker grill having concentric structure, and the speaker device not provided with the speaker grille. The horizontal axis is the frequency (KHz), and the vertical axis is the sound pressure (db SPL).

As shown in FIG. 10, peaks and dips, particularly a large dip, occurred in the high resolution region of 20 KHz or more with the conventional speaker device X provided with the speaker grille having the concentric structure, but noticeable peaks or dips did not occur with the speaker device 1. In addition, with the speaker device not provided with a speaker grille, peaks or dips did not occur, indicating that interference or blocking of the sound does not occur.

For the speaker device 1 in which the crosspiece portion 12 is formed into a non-concentric shape, the result, which indicates that noticeable peaks or dips did not occur and good sound quality is secured, was thus obtained.

Modification Examples of Speaker Grille

Hereinafter, each modification example of the speaker grille 6 will be described (see FIGS. 11 to 42).

Although the example of the speaker grille 6 having nine first curved portions 14, 14 and so on and nine second curved portions 15, 15 and so on has been shown above, the speaker device 1 may be provided with a speaker grille 6A according to a first modification example, a speaker grille 6B according to a second modification example or a speaker grille 6C according to a third modification example, in which the numbers of the first curved portions 14, 14 and so on and the second curved portions 15, 15 and so on are different as follows (see FIGS. 11 to 34).

For example, the speaker grille 6A has seven first curved portions 14, 14 and so on and seven second curved portions 15, 15 and so on, in which the outer diameter of a frame-shaped portion 11 is made shorter than the outer diameter of the frame-shaped portion 11 of the speaker grille 6 (see FIGS. 11 to 18). In the speaker grille 6A, the first curved portions 14 and 14 and respective portions of three second curved portions 15, 15 and so on positioned between these first curved portions 14 and 14 constitute the identically-shaped portion 16, and the identically-shaped portions 16, 16 and so on are continuously formed in the circumferential direction.

For example, the speaker grille 6B has six first curved portions 14, 14 and so on and six second curved portions 15, 15 and so on, in which the outer diameter of a frame-shaped portion 11 is made shorter than the outer diameter of the frame-shaped portion 11 of the speaker grille 6A (see FIGS. 19 to 26). In the speaker grille 6B, the first curved portions 14 and 14 and each portion of three second curved portions 15, 15 and 15 positioned between these first curved portions 14 and 14 constitute the identically-shaped portion 16, and the identically-shaped portions 16, 16 and so on are continuously formed in the circumferential direction.

For example, the speaker grille 6C has five first curved portions 14, 14 and so on and five second curved portions 15, 15 and so on, in which the outer diameter of a frame-shaped portion 11 is made shorter than the outer diameter of the frame-shaped portion 11 of the speaker grille 6B (see FIGS. 27 to 34). In the speaker grille 6C, the first curved portions 14 and 14 and each portion of two second curved portions 15 and 15 positioned between these first curved portions 14 and 14 constitute the identically-shaped portion 16, and the identically-shaped portions 16, 16 and so on are continuously formed in the circumferential direction.

Moreover, instead of the speaker grille 6, the speaker grille 6A, the speaker grille 6B or the speaker grille 6C, the speaker device 1 may be provided with a speaker grille 6D according to a fourth modification example, a speaker grille 6E according to a fifth modification example, a speaker grille 6F according to a sixth modification example or a speaker grille 6G according to a seventh modification example, in which the constitutions of the crosspiece portions are different as follows (see FIGS. 35 to 42).

Figure 35:
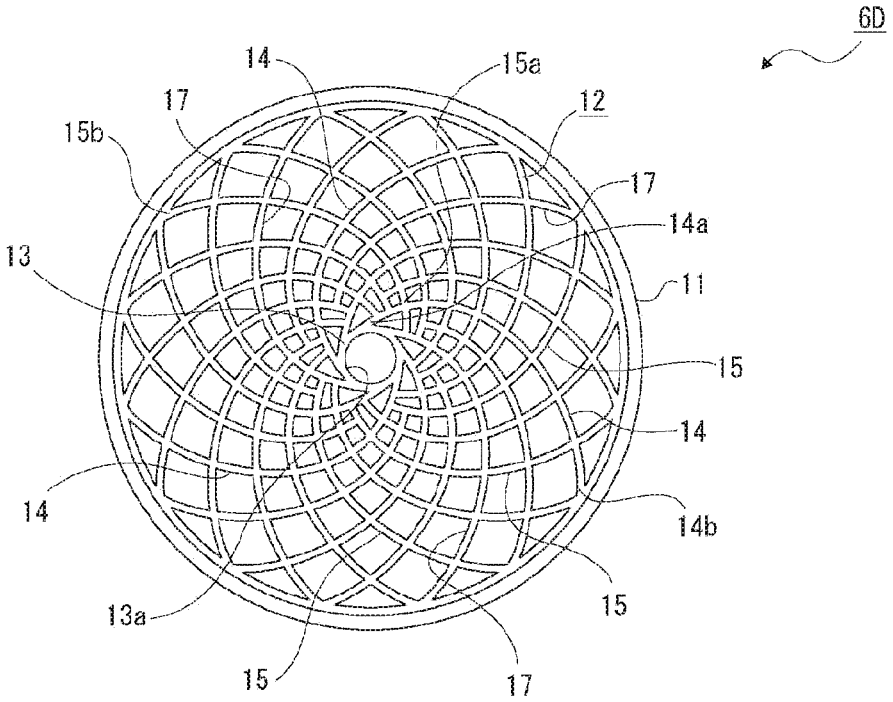
FIG. 35 is a front view of a speaker grille according to a fourth modification example.
Figure 36:
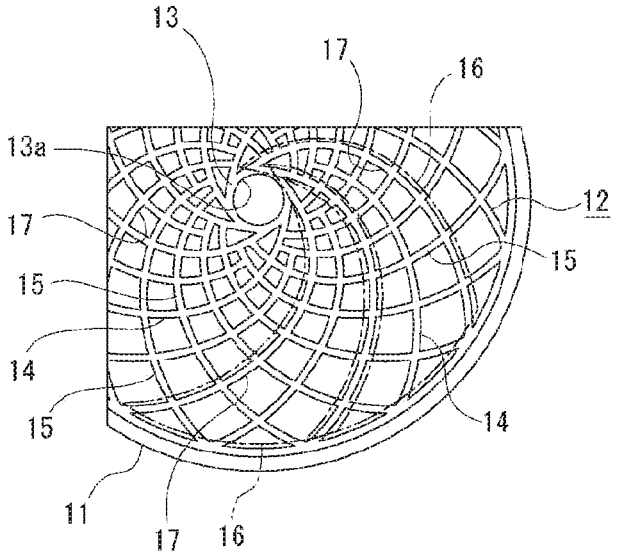
FIG. 36 is a front view showing identically-shaped portions of the speaker grille according to the fourth modification example.

In the speaker grille 6D, two kinds of first curved portions 14, 14 and so on with different lengths are provided alternately in a crosspiece portion 12 in the circumferential direction, and the length of one of the adjacent first curved portions 14 and 14 is slightly shorter than that of the other (see FIG. 35). In the speaker grille 6D, the numbers of first curved portions 14, 14 and so on and second curved portions 15, 15 and so on are greater than those of the speaker grille 6. In the speaker grille 6D, three first curved portions 14, 14 and 14 and respective portions of a plurality of second curved portions 15, 15 and so on positioned between these first curved portions 14, 14 and 14 constitute the identically-shaped portion 16 (see FIG. 36), and the identically-shaped portions 16, 16 and so on are continuously formed in the circumferential direction.

Figure 37:
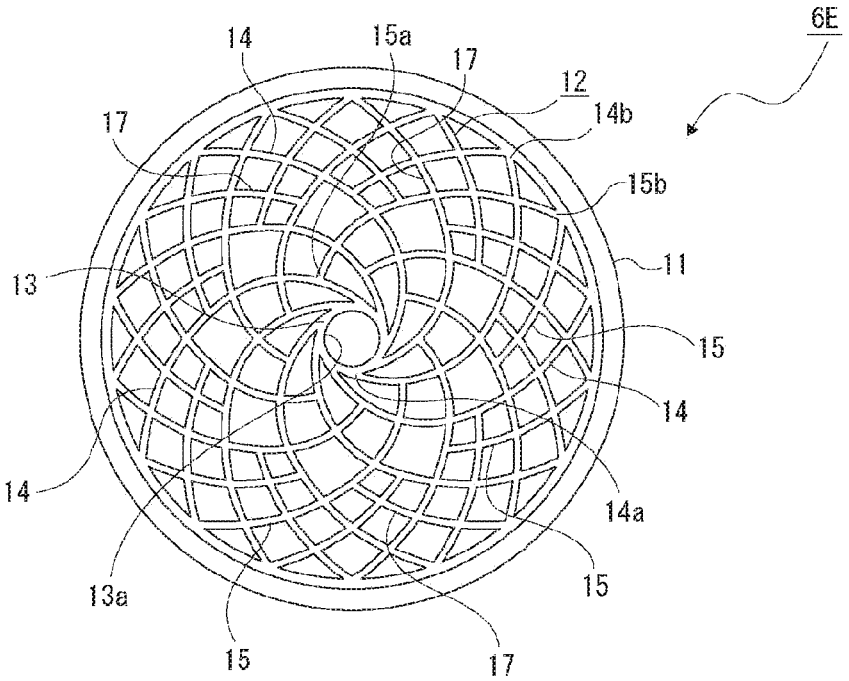
FIG. 37 is a front view of a speaker grille according to a fifth modification example.
Figure 38:
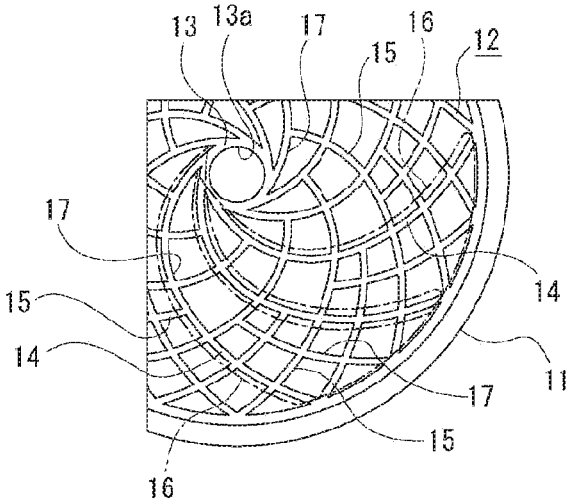
FIG. 38 is a front view showing identically-shaped portions of the speaker grille according to the fifth modification example.

In the speaker grille 6E, two kinds of first curved portions 14, 14 and so on with different lengths are provided alternately in a crosspiece portion 12 in the circumferential direction, and the length of one of the adjacent first curved portions 14 and 14 is about half that of the other (see FIG. 37). In the speaker grille 6E, the numbers of first curved portions 14, 14 and so on and second curved portions 15, 15 and so on are greater than those of the speaker grille 6. In the speaker grille 6E, three first curved portions 14, 14 and 14 and respective portions of a plurality of second curved portions 15, 15 and so on positioned between these first curved portions 14, 14 and 14 constitute the identically-shaped portions 16 (see FIG. 38), and the identically-shaped portions 16, 16 and so on are continuously formed in the circumferential direction.

Figure 39:
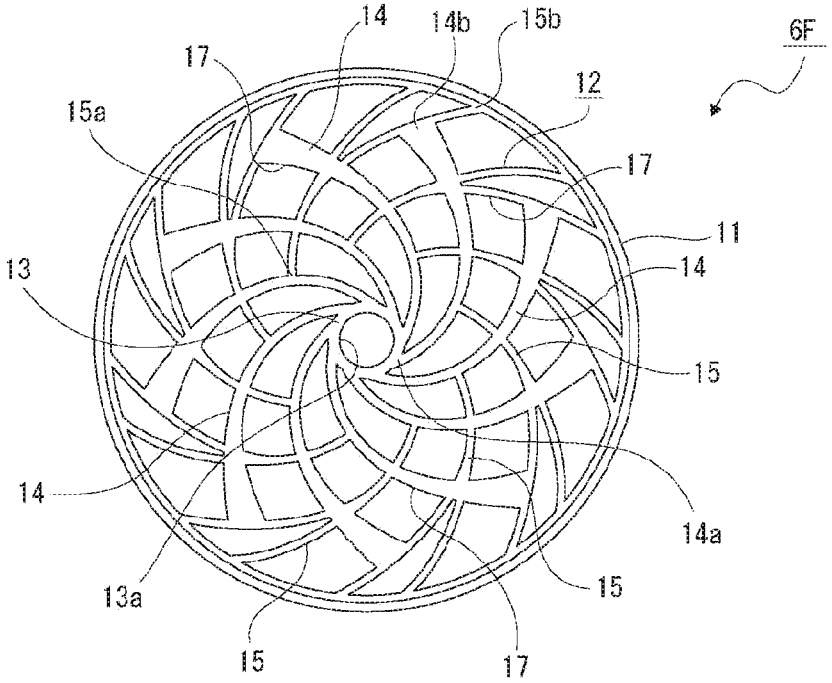
FIG. 39 is a front view of a speaker grille according to a sixth modification example.
Figure 40:
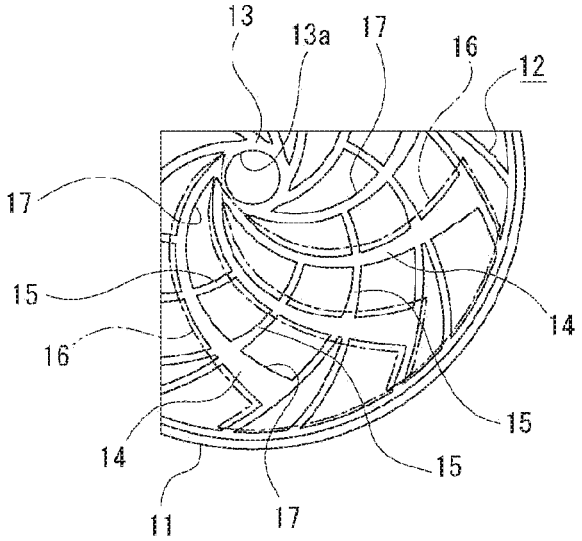
FIG. 40 is a front view showing identically-shaped portions of the speaker grille according to the sixth modification example.

A crosspiece portion 12 of the speaker grille 6F has first curved portions 14, 14 and so on, which couple an annular portion 13 with second curved portions 15, 15 and so on, and the second curved portions 15, 15 and so on, which couple the first curved portions 14, 14 and so on with a frame-shaped portion 11 (see FIG. 39). The speaker grille 6F has, for example, nine first curved portions 14, 14 and so on and nine second curved portions 15, 15 and so on.

The first curved portions 14 are formed into shapes such that the widths thereof are widened from the annular portion 13 to the second curved portions 15. The outer end portions of the first curved portions 14 are coupled with portions of the second curved portions 15 close to the end portion of the frame-shaped portion 11.

The outer half portions of the second curved portions 15 are formed into bifurcated shapes, and both of the bifurcated portions are coupled with the frame-shaped portion 11. The outer end portions of the first curved portions 14 are coupled with ones of the bifurcated portions of the second curved portions 15.

In the speaker grille 6F, two adjacent first curved portions 14 and 14, each portion of two second curved portions 15 and 15 positioned between these first curved portions 14 and 14, and each portion of the two second curved portions 15 and 15 including the bifurcated portions positioned between the first curved portions 14 and the frame-shaped portion 11 constitute the identically-shaped portions 16 (see FIG. 40), and the identically-shaped portions 16, 16 and so on are continuously formed in the circumferential direction.

Figure 41:
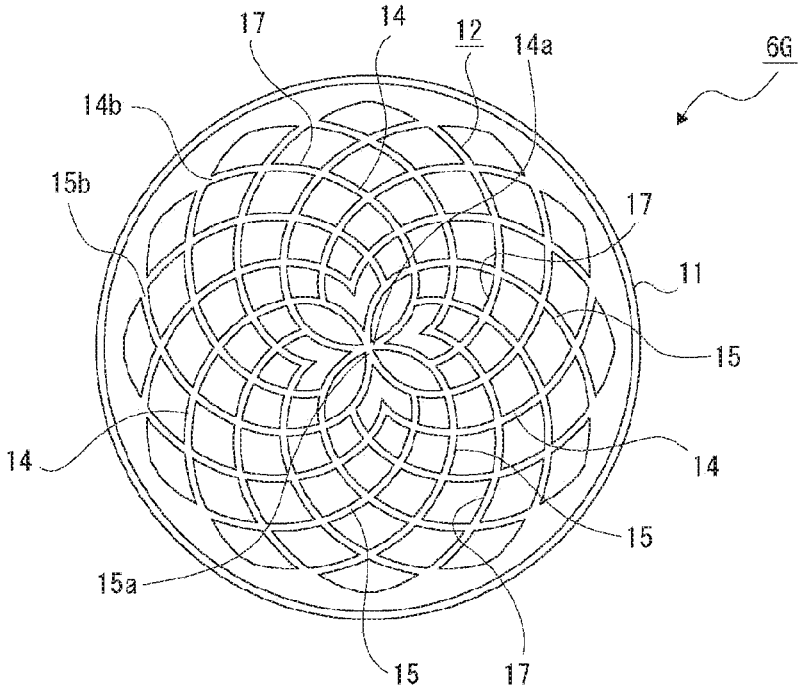
FIG. 41 is a front view of a speaker grille according to a seventh modification example.
Figure 42:
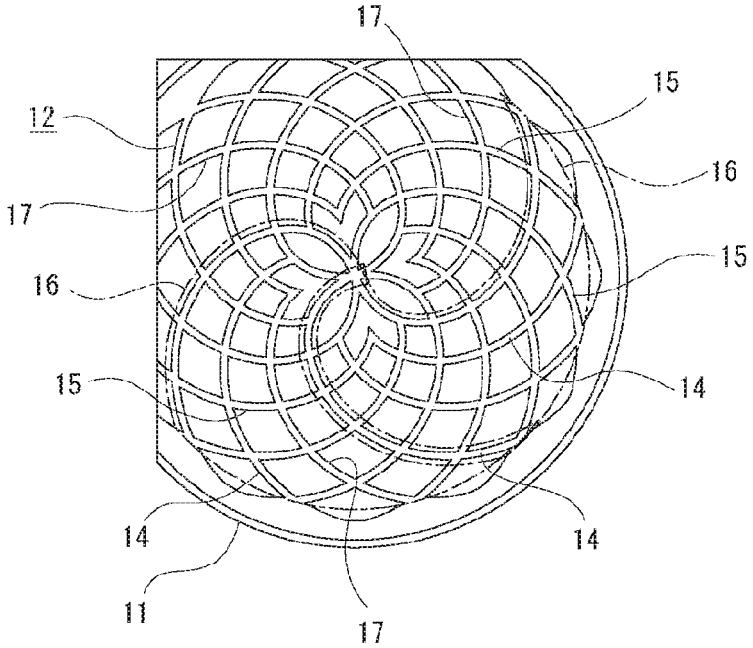
FIG. 42 is a front view showing identically-shaped portions of the speaker grille according to the seventh modification example.

In the speaker grille 6G, three kinds of first curved portions 14, 14 and so on with different lengths are repeatedly provided in a crosspiece portion 12 in the circumferential direction, and the first curved portions 14, 14 and so on with the longest length are joined at the central portion of a frame-shaped portion 11 (see FIG. 41). Therefore, the speaker grille 6G is not provided with an annular portion 13. One end portions of the first curved portions 14, 14 and so on with the intermediate length are joined to the respective second curved portions 15, 15 and so on at positions close the center of the frame-shaped portion 11, and each two one end portions of the first curved portions 14, 14 and so on with the shortest length are joined at positions close the center of the frame-shaped portion 11.

The second curved portions 15, 15 and so on are formed into inverted shapes of the first curved portions 14, 14 and so on, and the second curved portions 15, 15 and so on with the longest length are joined at the central portion of the frame-shaped portion 11. Therefore, the first curved portions 14, 14 and so on with the longest length and the second curved portions 15, 15 and so on with the longest length are joined at the central portion of the frame-shaped portion 11.

In the speaker grille 6G, four adjacent first curved portions 14, 14 and so on and respective portions of a plurality of second curved portions 15, 15 and so on positioned between these first curved portions 14, 14 and so on constitute the identically-shaped portion 16 (see FIG. 42), and the identically-shaped portions 16, 16 and so on are continuously formed in the circumferential direction.

Note that suppressing protrusion portions 18, 18 and so on protruding rearward from the respective portions of the crosspiece portions 12 are provided and spaced apart from one another in the circumferential direction in the speaker grilles 6A, 6B, 6C, 6D, 6E, 6F and 6G although not shown. However, the suppressing protrusion portions 18, 18 and so on may be not provided in the speaker grilles 6A, 6B, 6C, 6D, 6E, 6F and 6G.

<Summary>

As described above, in the speaker device 1, the speaker grilles 6, 6A, 6B, 6C, 6D, 6E, 6F and 6G (hereinafter referred to as "the speaker grille 6 to the speaker grille 6G") are each provided with the frame-shaped portion 11, which is annularly formed, and the crosspiece portion 12, which is positioned at the inner side of the frame-shaped portion 11 and partly continuous with the frame-shaped portion 11, and the crosspiece portion 12 is formed into a non-concentric shape and at least partly formed into a curved shape.

Therefore, since the crosspiece portion 12 is constituted with the structure having the curved portion in a state in which the constitution with a concentric shape is not present, dips, in particular, hardly occur in the frequency characteristics, and a good output state of the sound can be secured.

Moreover, by forming the frame-shaped portion 11 into a toric shape, the frame-shaped portion 11 has a simple shape, so that the speaker grille 6 to the speaker grille 6G can be easily molded. Furthermore, by forming the frame-shaped portion 11 into a toric shape, the directivity of the outputted sound is reduced, so that a good output state of the sound can be secured.

Further, since the crosspiece portion 12 of each of the speaker grille 6 to the speaker grille 6G is formed into a point-symmetric shape about the center of the frame-shaped portion 11, the openings 17, 17 and so on are formed into point-symmetric shapes about the center of the frame-shaped portion 11, the directivity of the outputted sound is reduced, and a good output state of the sound can be secured.

Still further, since the crosspiece portion 12 of each of the speaker grille 6 to the speaker grille 6G has the plurality of the identically-shaped portions 16, 16 and so on continuously formed in the circumferential direction, the total area of the openings 17, 17 and so on of the identically-shaped portions 16 and 16 adjacent in the circumferential direction are made the same, the directivity of the outputted sound is reduced, and a good output state of the sound can be secured.

In addition, since the crosspiece portion 12 of each of the speaker grille 6 to the speaker grille 6G is constituted by only the curved portions, an angular portion is not present in the crosspiece portion 12, stress concentration hardly occurs, and the sound quality can be improved while high rigidity is secured.

Moreover, in the crosspiece portion 12 of each of the speaker grille 6 to the speaker grille 6G, the first curved portions 14, 14 and so on and the second curved portions 15, 15 and so on, which are provided as curvature changing portions whose curvatures decrease from the central portion of the frame-shaped portion 11 toward the frame-shaped portion 11, are provided and spaced apart from one another in the circumferential direction.

Therefore, it is possible to constitute the crosspiece portion 12 with spiral structure by the plurality of curvature changing portions, and the sound quality can be improved while high rigidity and good designability are secured.

Note that the crosspiece portion 12 of each of the speaker grille 6 to the speaker grille 6G may be constituted by only a plurality of curvature changing portions. By constituting the crosspiece portions 12 by only the plurality of curvature changing portions, it is possible to constitute only spiral structure in the crosspiece portion 12 by the plurality of curvature changing portions, and the sound quality can be improved while high rigidity and better designability are secured.

Moreover, in the speaker grille 6 to the speaker grille 6G, since the thickness of the crosspiece portion 12 is made thinner than the thickness of the frame-shaped portion 11, the openings 17, 17 and so on are enlarged, and a good output state of the sound can be secured. In particular, it is possible to secure a good output state of the sound in the frequency range of high resolution for ultra-high sound quality (about 20 KHz or more).

Furthermore, except for the speaker grille 6F, the thickness of the crosspiece portion 12 of each of the speaker grille 6 to the speaker grille 6G is made constant, so that the strength of the crosspiece portion 12 does not differ depending on sites as well as the total opening area of the openings 17, 17 and so on can be certain level or more. Thus, it is possible to secure a certain level or more of the strengths of the speaker grilles 6, 6A, 6B, 6C, 6D, 6E and 6G as well as to secure a good output state of the sound.

Note that, since the thicknesses (widths) of the first curved portions 14, 14 and so on of the crosspiece portion 12 of the speaker grille 6F are made thicker toward the outer side, the strength of the crosspiece portion 12 is high. Thus, it is possible to secure the improvement of the strength as well as to secure a good output state of the sound.

Moreover, since the annular portion 13 is provided as a part of the crosspiece portion 12 at the central portion of the frame-shaped portion 11 of each of the speaker grilles 6, 6A, 6B, 6C, 6D, 6E and 6F, the opening 13*a* with a certain size is formed at the central portion of the frame-shaped portion 11, and a good output state of the sound can be secured.

Furthermore, since the annular portion 13 is formed into a toric shape, the opening 13*a* with a certain size is formed and a portion with a toric shape is present at the central portion of the frame-shaped portion 11. Thus, it is possible to secure a good output state of the sound as well as to secure high strength since the toric shape is a shape which does not cause stress concentration.

Further, since the speaker grille 6 to the speaker grille 6G are made including resin material containing glass filler, the strength of the material is enhanced by the glass filler, and high strength can be secured.

Note that, as described above, the speaker grilles 6, 6A, 6B, 6C, 6D, 6E and 6F are constituted in a state in which the one end portions 14*a* of the first curved portions 14 are made continuous with the annular portion 13 whereas the one end portions 15*a* of the second curved portions 15 are made continuous with the first curved portions 14. By adopting the constitution, as described above, in which the one end portions 15*a* of the second curved portions 15 are not continuous with the annular portion 13 but are continued with the first curved portions 14, the areas of the openings 17, 17 and so on in the region around the annular portion 13 are enlarged. Thus, it is possible to secure good frequency characteristics regarding the sound output by securing high aperture ratios.

Moreover, the speaker grilles 6, 6A, 6B, 6C, 6D, 6E and 6F are constituted such that the opening area of the opening 13*a* of the space at the inner side of the annular portion 13 and each of the opening areas of the openings 17, 17 and so on formed by the first curved portions 14, 14 and so on and the second curved portions 15, 15 and so on are made to be not largely different, and a difference between the opening areas does not partially occur over the entireties of the speaker grilles 6, 6A, 6B, 6C, 6D, 6E and 6F. Therefore, the directivity of the outputted sound is reduced, and a good output state of the sound can be secured.

Furthermore, the speaker grille 6 to the speaker grille 6G are constituted such that the opening 13*a* and the openings 17 are formed with opening areas to an extent that the tip of a finger or shaft-shaped structural object, such as a writing tool or the like, does not reach the diaphragm 5 when being inadvertently brought into contact, and the diaphragm 5 is protected by the crosspiece portion 12, for example.

Further, since each of the speaker grille 6 to the speaker grille 6G are provided with the suppressing protrusion portions 18, 18 and so on, excessive vibration of the diaphragm 5 is prevented by the suppressing protrusion portions 18, 18 and so on when the diaphragm 5 vibrates, and the sound quality can be improved. Still further, by providing the suppressing protrusion portions 18, 18 and so on, the suppressing protrusion portions 18, 18 and so on also function as reinforcing ribs, the rigidities of the speaker grille 6 to the speaker grille 6G can be improved.

In addition, in the speaker grille 6 to the speaker grille 6G, the first curved portions 14, 14 and so on and the second curved portions 15, 15 and so on are formed into curved shapes to which the Fibonacci sequence is applied, and the first curved portions 14, 14 and so on and the second curved portions 15, 15 and so on are both provided and spaced apart from one another in the circumferential direction.

Therefore, it is possible to constitute the crosspiece portion 12 with spiral structure by the first curved portions 14, 14 and so on and the second curved portions 15, 15 and so on as well as it is easy to design the shapes of the first curved portions 14, 14 and so on and the second curved portions 15, 15 and so on. Thus, the sound quality can be improved while high rigidity, good designability and ease of designing are ensured.

Note that, as described above, each of the speaker grille 6 to the speaker grille 6G has the crosspiece portion 12 gradually displaced forward from the frame-shaped portion 11 to the central portion of the frame-shaped portion 11 and is formed into a shape convex forward as a whole. In addition, the front-rear widths of the first curved portions 14 and the second curved portions 15 are made longer the vertical widths and the horizontal widths thereof. Therefore, the strengths of the speaker grille 6 to the speaker grille 6G are improved.

Application Example to Headphones

Figure 43:
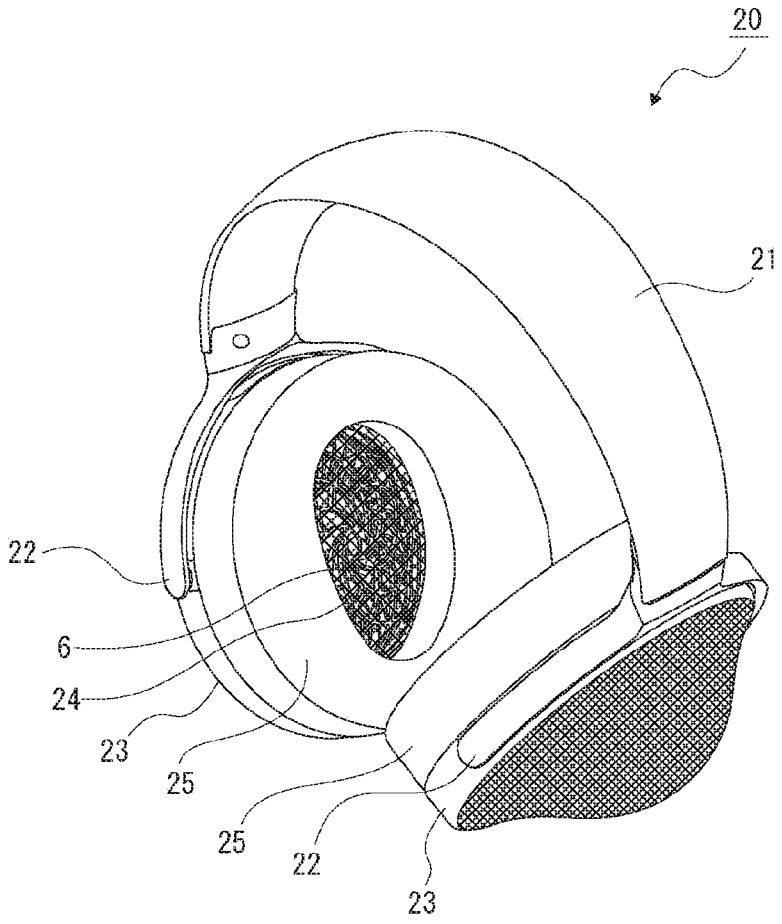
FIG. 43 shows an example in which the speaker grille according to the present technology is used in headphones together with FIGS. 44 and 45 and is a perspective view of the headphones.
Figure 44:
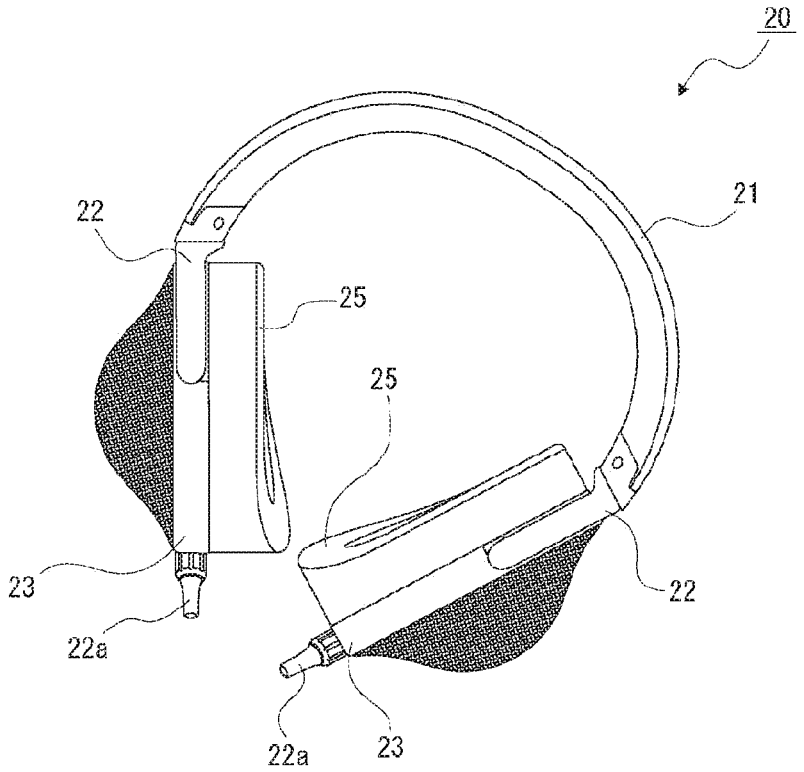
FIG. 44 is a front view of the headphones.
Figure 45:
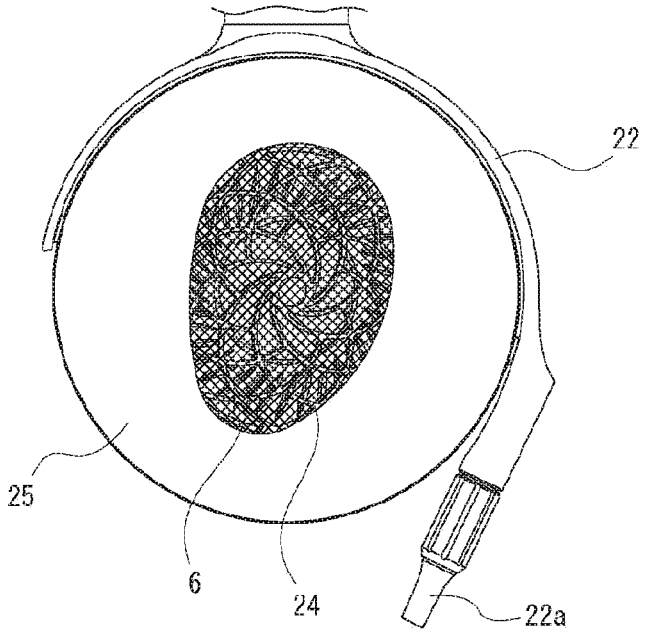
FIG. 45 is a side view showing a portion of the headphones where the speaker grille is disposed.

Hereinafter, an example in which the speaker grille 6 is used in headphones will be described (see FIGS. 43 to 45).

Note that the example in which the speaker grille 6 is used is shown hereinafter, but any one of the speaker grilles 6A, 6B, 6C, 6D, 6E, 6F and 6G may be used instead of the speaker grille 6.

Headphones 20 has a headband 21, hangers 22 and 22 and housings 23 and 23.

The headband 21 is formed into a bent shape and is elastically deformable in a direction in which both end portions in longitudinal direction come into contact and away from each other. The headband 21 may be provided with a slide mechanism for adjusting the length thereof.

The hangers 22 and 22 are coupled with both end portions of the headband 21 in the longitudinal direction, respectively. The hangers 22 and 22 are provided with cord connection portions 22*a* and 22*a*, respectively, and the cord connection portions 22*a* and 22*a* are connected to cables (not shown), respectively.

The housings 23 and 23 are coupled with the hangers 22 and 22, respectively, and are rotatable from the hangers 22 and 22. Speaker devices (speaker units) are arranged inside the housings 23 and 23, respectively. The speaker devices arranged inside the housings 23 and 23 have the speaker grilles 6 and 6, respectively, and the speaker grilles 6 and 6 are positioned at the inner sides of the speaker devices, respectively.

On the outer surface sides of the speaker grilles 6 and 6, nets 24 and 24 with meshes are arranged, respectively. The nets 24 and 24 protect the speaker grilles 6 and 6 and suppress the entry of dust into the speaker devices.

To the inner surfaces of the housings 23 and 23, ear pads 25 and 25 to which ears are fitted are attached, respectively. The ear pads 25 and 25 are formed into annular shapes, and at least each part of the speaker grilles 6 and 6 and the nets 24 and 24 are exposed from the inner space.

The headphones 20 constituted as described above are fitted to the head by fitting the ear pads 25 and 25 to the respective ears and fitting the headband 21 to the top of the head. The sound outputted from each speaker device is transmitted to each ear through the speaker grilles 6 and 6 and the nets 24 and 24.

Even in the case where the speaker grille 6 is thus used in the headphones 20, the speaker grille 6 has the frame-shaped portion 11, which is annularly formed, and the crosspiece portion 12, which is formed into a non-concentric shape and partly formed into a curved shape. Thus, dips, in particular, hardly occur in the frequency characteristics, and a good output state of the sound can be secured.

<Present Technology>

Note that the present technology may also adopt the following constitutions.

(1)

A speaker grille including:

a frame-shaped portion which is formed into an annular shape; and a crosspiece portion which is positioned at an inner side of the frame-shaped portion and is partly continuous with the frame-shaped portion, in which the crosspiece portion is formed into a non-concentric shape as well as is at least partly formed as a curved portion with a curved shape.

(2)

The speaker grille according to (1), in which the frame-shaped portion is formed into a toric shape.

(3)

The speaker grille according to (2), in which the crosspiece portion is formed into a point-symmetric shape about a center of the frame-shaped portion.

(4)

The speaker grille according to any one of (1) to (3), in which the crosspiece portion is provided with a plurality of identically-shaped portions formed into a same shape, and the plurality of the identically-shaped portions is continuously formed in a circumferential direction of the frame-shaped portion.

(5)

The speaker grille according to any one of (1) to (4), in which the crosspiece portion is constituted by only a plurality of the curved portions.

(6)

The speaker grille according to any one of (1) to (5), in which a plurality of curvature changing portions, whose curvatures decrease from a central portion of the frame-shaped portion toward the frame-shaped portion, is provided and spaced apart from one another at the crosspiece portion in the circumferential direction of the frame-shaped portion.

(7)

The speaker grille according to (6), in which the crosspiece portion is constituted by only the plurality of the curvature changing portions.

(8)

The speaker grille according to any one of (1) to (7), in which a thickness of the crosspiece portion is made thinner than a thickness of the frame-shaped portion.

(9)

The speaker grille according to any one of (1) to (8), in which a thickness of the crosspiece portion is made constant.

(10)

The speaker grille according to any one of (1) to (9), in which an annular portion is provided as a part of the crosspiece portion at a central portion of the frame-shaped portion.

(11)

The speaker grille according to (10), in which the annular portion is formed into a toric shape.

(12)

The speaker grille according to any one of (1) to (11), in which the speaker grille is made including resin material containing glass filler.

(13)

The speaker grille according to any one of (1) to (12), in which a suppressing protrusion portion which protrudes in one side in an axial direction of the frame-shaped portion from the crosspiece portion and suppresses vibration of a diaphragm, is provided.

(14)

The speaker grille according to any one of (1) to (13), in which the curved portion is formed into a curved shape to which a Fibonacci sequence is applied, and the plurality of the curved portions is provided and spaced apart from one another in the circumferential direction of the frame-shaped portion.

(15)

A speaker device including:

a frame which functions as a housing;

a diaphragm which vibrates when sound is outputted;

a magnetic circuit which vibrates the diaphragm; and a speaker grille which is attached to the frame, in which the speaker grille is provided with a frame-shaped portion which is formed into an annular shape, and a crosspiece portion which is positioned at an inner side of the frame-shaped portion and partly continuous with the frame-shaped portion, and the crosspiece portion is formed into a non-concentric shape as well as at least partly formed as a curved portion with a curved shape.

REFERENCE SIGNS LIST

1 Speaker device
2 Frame
3 Magnetic circuit
5 Diaphragm
6 Speaker grille
11 Frame-shaped portion
12 Crosspiece portion
13 Annular portion
14 First curved portion
15 Second curved portion
16 Identically-shaped portion
18 Suppressing protrusion portion
6A Speaker grille
6B Speaker grille
6C Speaker grille
6D Speaker grille
6E Speaker grille
6F Speaker grille
6G Speaker grille

The invention claimed is:

1. A speaker grille, comprising:

a frame-shaped portion in an annular shape;

a crosspiece portion in an inner side of the frame-shaped portion, wherein the crosspiece portion is continuous with the frame-shaped portion, and the crosspiece portion is in a non-concentric shape and a curved shape; and a suppressing protrusion portion configured to suppress vibration of a diaphragm, wherein the suppressing protrusion portion protrudes, in one side in an axial direction of the frame-shaped portion, from the crosspiece portion.

2. The speaker grille according to claim 1, wherein the frame-shaped portion is in a toric shape.

3. The speaker grille according to claim 2, wherein the crosspiece portion is in a point-symmetric shape about a center of the frame-shaped portion.

4. The speaker grille according to claim 1, wherein the crosspiece portion includes a plurality of identically-shaped portions of a same shape, and the plurality of the identically-shaped portions is continuous in a circumferential direction of the frame-shaped portion.

5. The speaker grille according to claim 1, wherein the crosspiece portion includes a plurality of curved portions, and the plurality of curved portions is in the curved shape.

6. The speaker grille according to claim 1, wherein the crosspiece portion includes a plurality of curvature changing portions, a curvature of each of the plurality of curvature changing portions decreases from a central portion of the frame-shaped portion toward a peripheral portion of the frame-shaped portion, and a first curvature changing portion of the plurality of curvature changing portions is spaced apart from a second curvature changing portion of the plurality of curvature changing portions in a circumferential direction of the frame-shaped portion.

7. The speaker grille according to claim 6, wherein the crosspiece portion constitutes the plurality of curvature changing portions.

8. The speaker grille according to claim 1, wherein a thickness of the crosspiece portion is thinner than a thickness of the frame-shaped portion.

9. The speaker grille according to claim 1, wherein a thickness of the crosspiece portion is constant.

10. The speaker grille according to claim 1, wherein the crosspiece portion includes an annular portion in a central portion of the frame-shaped portion.

11. The speaker grille according to claim 10, wherein the annular portion is in a toric shape.

12. The speaker grille according to claim 1, wherein the speaker grille is of a resin material containing glass filler.

13. The speaker grille according to claim 1, wherein the crosspiece portion includes a plurality of curved portions in the curved shape, a Fibonacci sequence is applicable to the plurality of curved portions, and a first curved portion of the plurality of curved portions is spaced apart from a second curved portion of the plurality of curved portions in a circumferential direction of the frame-shaped portion.

14. A speaker device, comprising:

a frame;

a diaphragm configured to vibrate based on output of a sound;

a magnetic circuit configured to control the diaphragm; and a speaker grille attached to the frame, wherein the speaker grille includes:

a frame-shaped portion in an annular shape;

a crosspiece portion in an inner side of the frame-shaped portion, wherein the crosspiece portion is continuous with the frame-shaped portion, and the crosspiece portion is in a non-concentric shape and a curved shape; and a suppressing protrusion portion configured to suppress the vibration of the diaphragm, wherein the suppressing protrusion portion protrudes, in one side in an axial direction of the frame-shaped portion, from the crosspiece portion.

* * * * *